US005429193A

United States Patent [19]

Hegebarth et al.

[11] Patent Number: 5,429,193

[45] Date of Patent: Jul. 4, 1995

[54] PISTON PUMP AND APPLICATIONS THEREFOR

[75] Inventors: Donald C. Hegebarth, Naperville; Mark J. Bertane, Glen Ellyn, both of Ill.

[73] Assignee: Blackhawk Environmental Company, Elgin, Ill.

[21] Appl. No.: 214,405

[22] Filed: Mar. 16, 1994

[51] Int. Cl.[6] ..... F04B 47/04

[52] U.S. Cl. ..... 166/369; 166/68; 417/453; 417/454

[58] Field of Search ..... 166/369, 68, 68.5, 105; 417/554, DIG. 2, 454, 570, 448, 453

[56] References Cited

U.S. PATENT DOCUMENTS

| | | | |
|---|---|---|---|
| 967,498 | 8/1910 | Clark | 417/453 |
| 1,118,787 | 11/1914 | McGee | 417/453 |
| 2,154,331 | 4/1939 | Hathcock | 417/453 |
| 2,229,539 | 1/1941 | Zublin | 166/68.5 X |
| 2,281,801 | 5/1942 | Reynolds et al. | 166/2 |
| 2,605,717 | 8/1952 | Canon | 417/453 |
| 2,743,676 | 5/1956 | Lewis | 417/453 |
| 2,982,355 | 5/1961 | Rodgers | 166/68 |
| 4,217,212 | 8/1980 | Deal | 210/19 |
| 4,628,994 | 12/1986 | Towner et al. | 166/68 |
| 4,637,462 | 1/1987 | Grable | 166/245 |
| 4,643,258 | 2/1987 | Kime | 166/68 X |
| 4,669,536 | 6/1987 | Ames et al. | 166/68 |
| 4,678,369 | 7/1987 | Glaser | 405/129 |
| 4,688,999 | 8/1987 | Ames et al. | 417/550 |
| 4,765,902 | 8/1988 | Ely et al. | 210/610 |
| 4,768,595 | 9/1988 | Smith | 166/369 |
| 4,810,131 | 3/1989 | Turner | 405/129 |
| 4,927,292 | 5/1990 | Justice | 405/43 |
| 4,966,534 | 10/1990 | Hasslen, III | 417/423 |
| 4,992,030 | 2/1991 | Hasslen, III | 417/360 |
| 5,106,232 | 4/1992 | Metzer et al. | 405/128 |

OTHER PUBLICATIONS

Product literature from Baker, 133 Enterprise Street, Evansville, Wisconsin 53536 for Monitor PowerSaver, Jacks, Pumps, Well Supplies, Catalog AD10, Mar. 1, 1989. With price list effective Oct. 1, 1992.

Product literature from Dempster Industries Inc., Beatrice, Nebraska 68310; data Sheet 380-2, Issue Date 1981, concerning Pump Jack; sheets 19-20 with indications Dec. 1, 1991 concerning non-powered pump jacks and non-powered pump jack components; data sheet 380-383 issue date 1980 concerning pumps and cylinders; sheets 5-6 with indications Jan. 30, 1993 concerning hand & wind mill pumps and pumps accessories.

Product literature from EPG Companies Inc., P.O. Box 224, 9060 Zachary Lane N., Suite 115, Maple Grove, Minnesota 55369, concerning the SurePump TM Leachate Removal System from EPG Companies with notation protected by U.S. Pat. No. 4,966,534 and 4,992,030.

Product literature from Harbison-Fischer, P.O. Box 2477, Forth Worth, Texas 76113, 1994-1995 Condensed Catalog for Harbison-Fisher Sub-Surface Pumps.

(List continued on next page.)

*Primary Examiner*—William P. Neuder

*Attorney, Agent, or Firm*—Marshall, O'Toole, Gerstein, Murray & Borun

[57] ABSTRACT

A durable, economical, easy-to-repair device for elevating liquid through a well in a landfill or other geological site, comprising a casing for channeling liquid having inlet and outlet openings at either end, a removable, valve-containing piston assembly for elevating liquid toward the outlet, and a second, stationary valve. Means are provided to remove the stationary valve along with the piston valve. The device preferably includes an actuator for driving the piston assembly and a liner to protect the casing. Also, a method of installing and using a device for elevating liquid through a well in a landfill or other geological site, comprising the steps of inserting a casing for channeling liquid into the geological site; inserting a stationary valve into the casing; inserting into the casing a removable, valve-containing piston for elevating liquid; and reciprocally raising and lowering the piston to elevate liquid from below the surface of the geological site through the casing toward the surface.

39 Claims, 14 Drawing Sheets

OTHER PUBLICATIONS

Product literature from Instrumentation Northwest, Inc., 14972 N.E. 31st Circle, Redmond, Wash. 98052, concerning HydroStar TM Ground Water Sampling System.

Product literature from Instrumentation Northwest, Inc., 14972 N.E. 31st Circle, Redmond, Wash. 98052, HydroStar TM Technical Information Document for the Bertane Company.

Product literature from Maass Midwest, P.O. 547, 11213 Dundee Road, Huntley, Illinois 60142-0547, Catalog 500.

Product literature from Muller Industries, Incorporated, Randolph, Nebraska 68771 U.S. Highway 81 North.

Product literature from Protec ®, 7136 S. Yale, Suite 200, Tulsa, Okla. 74136, concerning the Protec ® Recip ® Pump Groundwater & Leachate Recovery Pumps and Protec ® Rotary ® Pump Groundwater Recovery Pumps.

Product literature from Trico Industries, Inc., 3040 E. Slauson Avenue, P. O. Box 2909, Huntington Park, California 90255, 1990-1991 Catalog.

Product literature from Instrumentation Northwest, Inc. 14972 NE 31st Circle, Redmond, Wash. 98052 pertaining to Hydrostar TM Ground Water Sampling Pump.

Product literature for FIBERFLEX ® The Fiberglass Sucker Rod, P.O. Box 6044, Industrial Park, Big Spring, Texas 79721-6044.

Hicks, A. W., "Using Fiberglass Sucker Rods in Deep Wells," presented at the Deep Drilling and Production Symposium of the Society of the Society of Petroleum Engineers, Apr. 6-8, 1986, Austin, Texas.

Hicks, Alan W., "Chemical Corrosion and its Effect on Fiberglass Sucker Rods," presented as the Southwestern Petroleum Short Course Department of Petroleum Engineering, Texas Tech University, Lubbock, Texas, Apr. 27-28, 1983.

PISTON PUMP AND APPLICATIONS THEREFOR

FIELD OF THE INVENTION

This invention relates generally to devices and methods for pumping liquids, and more particularly to devices and methods for pumping liquids from a well in a landfill.

BACKGROUND INFORMATION

This invention relates to a mechanically-driven positive displacement piston pump containing chemically resistant materials, particularly suitable for economically pumping liquids from a well in situations where the liquids may be chemically and/or thermally corrosive, and where the well may be in an unstable geological site, and where removal of the pump from the well may be desirable.

BACKGROUND OF THE INVENTION

This invention broadly relates to economical methods and devices useful for pumping liquids from below the surface of a geological site to the surface for removal, collection and/or analysis. As such, the invention has many diverse applications that will be apparent to one skilled in the art. Examples of such applications include recovery of hydrocarbon seepage from subsurface storage tanks, groundwater monitoring and recovery, and monitoring and removal of leachate from a landfill. The term geological site includes both natural and man-made locations wherein it would be desirable to install the device of the present invention for the purpose of elevating liquid situated at (or within or beneath) the location.

More particularly, this invention relates to economical methods and devices that are particularly useful for pumping caustic or corrosive liquids from below the surface of a geological site to the surface for removal, collection and/or analysis. Conventional pumping devices typically are designed to pump water, or a fluid similar in viscosity to $H_2O$, but not corrosive liquids or viscous liquids. When such conventional devices are used in applications where the liquid being pumped is thermally corrosive, chemically corrosive, solid-laden, and/or viscous such devices quickly lose efficiency and break down. System breakdown is a problem that often is compounded when the location of the geological site or the depth of the well make repair and replacement of the device time consuming and costly.

Many of the advantages of the present invention will be apparent upon consideration of the problem of removal of leachate from a landfill, because hazardous liquid waste is created or disposed of in certain environments, such as landfills, and cost-effective means are needed for control and ongoing removal of such waste. A landfill that complies with environmental regulations usually includes a liquid impermeable liner at its bottom designed to contain waste that is dumped into a landfill recess. However, rainwater, liquid wastes within the landfill, and fermentation and decay reaction products of solid and liquid waste material in the landfill all contribute to the ongoing problem of the seepage of liquid (known as landfill leachate) to the bottom of the landfill.

Prudent operation of a landfill requires that landfill leachate accumulations be carefully monitored and constantly removed from the landfill. However, such monitoring and removal presents a number of problems for conventional pumping methods and devices. For example, conventional pumping systems that are typically designed to pump water may quickly fail in a landfill, where landfill leachate may be corrosive, may often range between 70° F.–180° F., and may reach temperatures of 200° F. or more in the landfill itself. A useful pumping device must be capable of withstanding such corrosive landfill leachate and high temperatures. Preferably, the components of the pumping device that come in contact with the leachate will be chemically inert such that the leachate can be recovered without substantial alteration so that the removed leachate may be chemically analyzed.

Properties of a landfill itself create more difficult problems for the monitoring and removal of landfill leachate. For example, it may be necessary to install the pumping device at depths of 100 feet or more below the surface of a landfill to remove the leachate. Therefore, boring a well and installing a pumping device can be an expensive and difficult operation. This problem is compounded in large landfills, in which multiple pumping devices may be necessary. For many conventional devices, the costs of repairing or replacing the devices when located at such depths is extremely burdensome, if the conventional device can be repaired or replaced at all. An inexpensive pump that is easy to construct and install at the monitoring site, and subsequently will provide dependable operation with minimal upkeep, has been a long-felt need in the art.

The fact that landfills tend to be unstable and subject to settling and decay poses additional problems for conventional pumping methods and devices that are used to remove landfill leachate. The settling and shifting of solid materials in a landfill can easily disturb the vertical integrity of a well in which the pumping device has been installed. The loss of such vertical integrity renders many conventional pumping devices inoperative. In fact, the valuable components of a pumping device may be irretrievably lost in such circumstances, particularly if the device is comprised of large inflexible components, such that it cannot be withdrawn from a well which has lost its vertical integrity. This drawback exists even for conventional devices that ordinarily might be removable from a vertical well. Improved means for recovery of a device, or components thereof, from a well, also have been a long-felt need in the art.

An additional property of a typical landfill is the production of gaseous wastes (e.g., methane) that may effect operation of a conventional pumping device and that preferably are removed from the landfill through the same recovery wells used to remove leachate.

For example, in a conventional pumping device, methane gas flow may cause turbulence in the leachate being removed and, conversely, the leachate may impair gas flow and recovery. Improved means for gas recovery with better gas flow, smoother gas recovery, and less turbulence inside the recovery well have been a long-felt need in the art.

SUMMARY OF THE INVENTION

The present invention provides methods and devices useful for pumping liquids from below the surface of a geological site to the surface for removal, subsequent collection, and/or analysis, in a manner that eliminates drawbacks and disadvantages of conventional methods and devices described above.

A device of the present invention for elevating liquid through a well from a landfill or other geological site comprises: a casing means or riser pipe for channeling liquid having an upper end and a lower end; a discharge means for removal of liquid from the casing means; a removable piston means, or piston assembly, for elevating liquid toward the discharge means comprising an actuating rod having an upper end and a lower end, and a piston valve unit operatively connected to the actuating rod, and disposed within the casing means; and a stationary valve unit disposed within the casing means, the stationary valve unit remaining in a substantially fixed position relative to the casing means during movement of the piston means. A valve unit of the device comprises: a valve casing; an aperture within the valve casing; a sealing means for preventing liquid communication around an outer periphery of the valve casing during operation of the device; and a valve means for permitting liquid to flow through the valve unit aperture toward the discharge means, and for preventing liquid from flowing through the valve unit aperture away from the discharge means. The stationary valve unit preferably is disposed below the piston means in the device. The actuating rod preferably comprises an elongate tubular structure or rod, such as a stainless steel pipe or solid stainless steel or fiberglass rod.

A device of the present invention may further include an actuating means or actuator operatively connected to the upper end of the actuating rod for imparting movement to the piston means; preferably, the actuating means is disposed above the surface of the geological site. An exemplary actuating means comprises a reciprocating air-driven cylinder, hydraulic-driven cylinder, or mechanically-driven cylinder, or electric-driven cylinder or can.

Desirably, the device further includes a filter means disposed below the valve units for preventing debris from contacting the valve units. To facilitate low-cost construction and maintenance, the piston valve unit of the device is substantially identical to the stationary valve unit.

The stationary valve unit preferably is removable. In preferred embodiments, the device further includes engagement means for reversibly connecting the piston means to the stationary valve unit. With such engagement means, the stationary valve unit of the device is removable from the riser pipe by connection of the piston means to the stationary valve unit followed by removal of the piston means. After removal from the device, the stationary valve unit may be disconnected from the piston means and repaired or replaced, as necessary. Thereafter, a stationary valve unit may be reconnected to the piston means. The stationary valve unit is reinsertable by connection of the stationary valve unit to the piston means, reinsertion of the piston means into the riser pipe, and disconnection of the piston means and the stationary valve unit. The engagement means may comprise compatible attachment structure disposed on a lower portion of the piston means and on an upper portion of the stationary valve unit. For example, compatible attachment means include a flange and a compatible means for receiving the flange; or a threaded portion of the piston means that is axially aligned and removably engageable with a threaded portion of the stationary valve unit. A manner in which the piston means and stationary valve unit may be attached is as follows: upon lowering of the piston means such that the piston means contacts the stationary valve unit and upon axial rotation of the piston means, the piston means and stationary valve units reversibly engage.

The device may further include retaining means for preventing downward movement of a valve unit, e.g., of a stationary valve unit. Preferably, such retaining means permits upward movement of the valve unit. In a device that includes a lining means as described below, the lining means preferably includes valve unit retaining means for preventing downward movement of a valve unit past the lower end of the lining means.

Preferred embodiments of the device further comprise a novel lining means for lining the riser pipe, the lining means being disposed within the riser pipe. The lining means preferably is a tubular structure constructed from stainless steel, and only occupies a short length of the riser pipe at the lower end of the device. The valve units of the device are disposed within the lining means. The device is constructed such that the sealing means of the valve units prevent liquid communication around an outer periphery of the valve casings when the valve units are disposed within the lining means. Advantageously, the device is also designed such that the sealing means of the valve units permit such liquid communication around the valve casing when the valve units are disposed within the riser pipe above the lining means. The device preferably further includes means for retaining the lining means in a substantially fixed position within the riser pipe. If the upper end of the lining means is flared radially outward, then the upper end of the lining means is capable of engaging the riser pipe, thereby serving as a lining retaining means.

In one embodiment, the device of the present invention further includes positioning means for changing the vertical position of the piston valve unit over different spans of the lining means to provide vertical movement of the piston valve unit within the lining means over different portions of the lining means for extending the useful life of the lining means.

In one variation, the riser pipe of the device is disposed within a well casing in the geological site. In a different variation, the riser pipe of the device also serves as the well casing in the geological site. Typically one will bore a well hole to construct either variation. However, it is possible to drive a riser pipe or well casing into the geological site without first boring a hole that is the well. To facilitate installation of such a riser pipe, the device may further include a piercing means disposed at the lower end of the riser pipe for piercing downwardly into the geological site. In such an embodiment the device may further include a liquid permeable section of riser pipe at the lower end of the riser pipe, wherein the valve units are disposed above the liquid permeable section of the riser pipe. The liquid permeable means may for example, be disposed just above a lowermost piercing means.

The present invention further provides methods for elevating liquid through a well in a landfill or other geological site. Such a method comprises: inserting into the geological site a casing means for channeling liquid, the casing means having an upper end and a lower end; inserting a stationary valve unit into the casing means; inserting into the casing means a removable piston means for elevating liquid into the casing means, the piston means comprising an actuating rod having an upper end and a lower end, and a piston valve unit operatively connected to the actuating rod; and reciprocally raising and lowering the piston means to elevate liquid through the casing means from below the surface of the geological site toward the surface. Such a method may further comprise operatively connecting an actuating means to the piston means for raising and lowering the piston means.

Preferred methods include the additional steps of inserting a lining means for lining the casing means into the casing means; disposing the stationary valve unit within the lining means; and disposing the piston valve unit of the piston means within the lining means.

Such methods have applications at any geological site, for example at a landfill, where landfill leachate is the liquid elevated.

In such methods, the step of inserting a stationary valve unit may be performed simultaneously with the step of inserting a piston means. For example, this may be achieved by reversibly connecting a stationary valve unit and a piston means; inserting the piston means into the casing means; and disconnecting the stationary valve unit from the piston means.

The devices of the present invention are very reliable and require little maintenance. However, when maintenance is required, partial or total disassembly of the device is easily achieved to facilitate rapid, inexpensive maintenance. To repair or replace a valve unit, for example, the present invention provides structure and methods for removing a valve unit from a device, such as removing the piston valve unit from the device by lifting the actuating rod from the casing means sufficiently for removal of the connected piston valve unit. To remove a stationary valve unit, such a method further includes reversibly connecting the stationary valve unit to the piston means before lifting the actuating rod sufficiently out of the casing means to expose and remove the stationary valve unit.

Other features and advantages are inherent in the structure and methods claimed and disclosed or will become apparent to those skilled in the art from the following detailed description in conjunction with the accompanying drawings.

DETAILED DESCRIPTION OF THE PREFERRED EMBODIMENTS

Figure 1A:
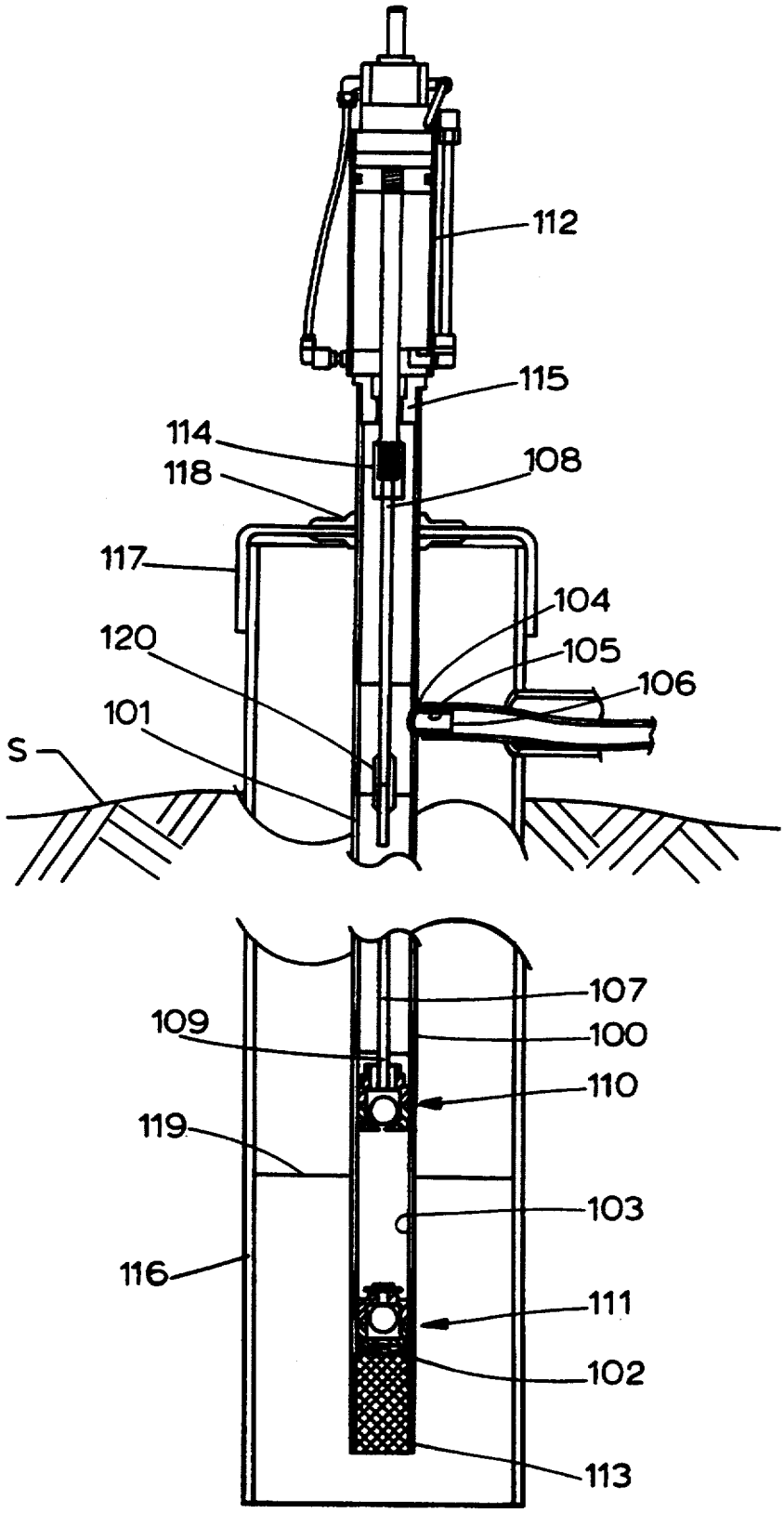
FIG. 1A is a partially elevated, partially cross-sectional side view, largely in section and partly cut-away, of one embodiment of the device of the present invention.
Figure 1B:
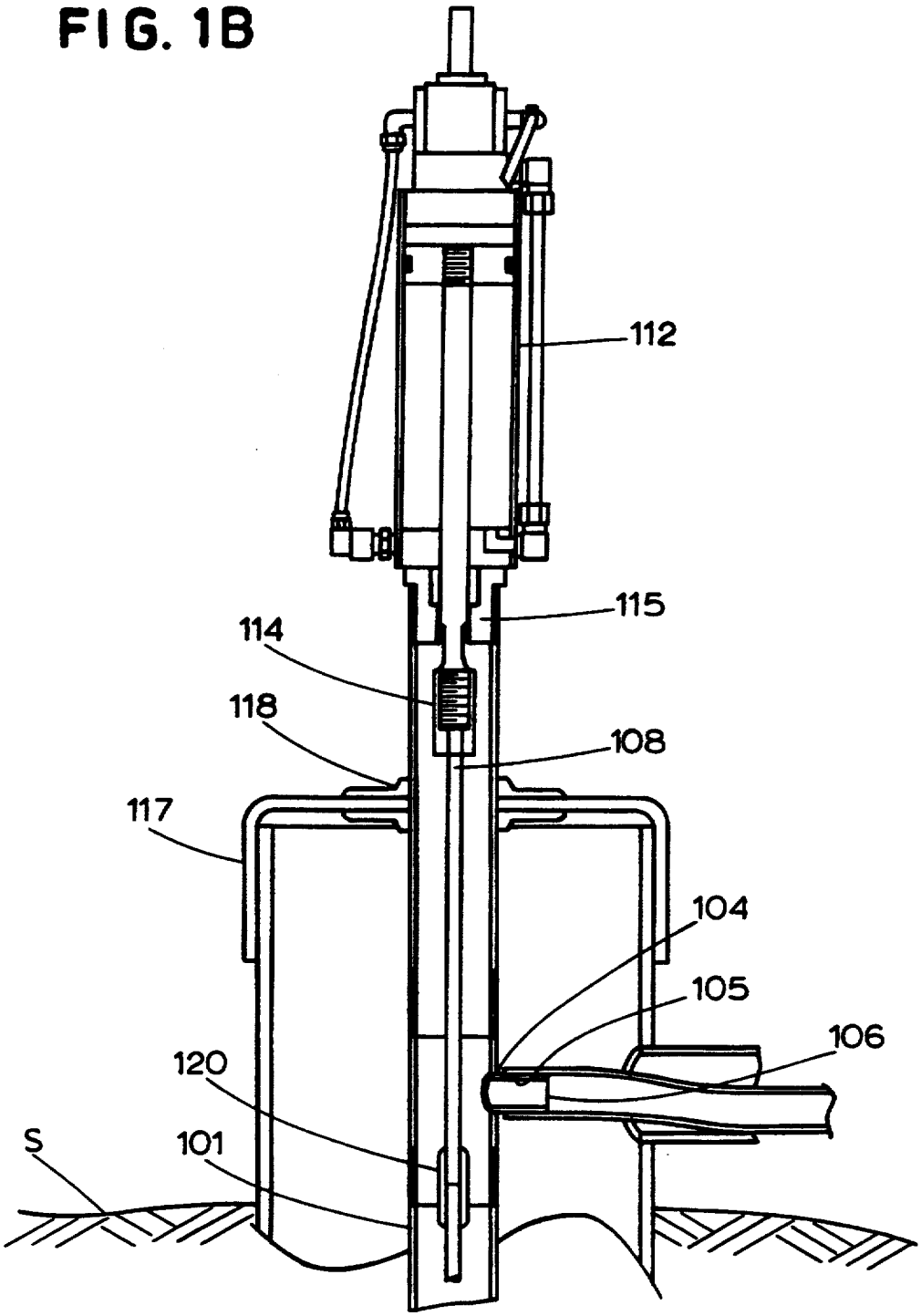
FIG. 1B is a partially elevated, partially cross-sectional side view of an upper portion of the device of FIG. 1A, enlarged to show detail.
Figure 1C:
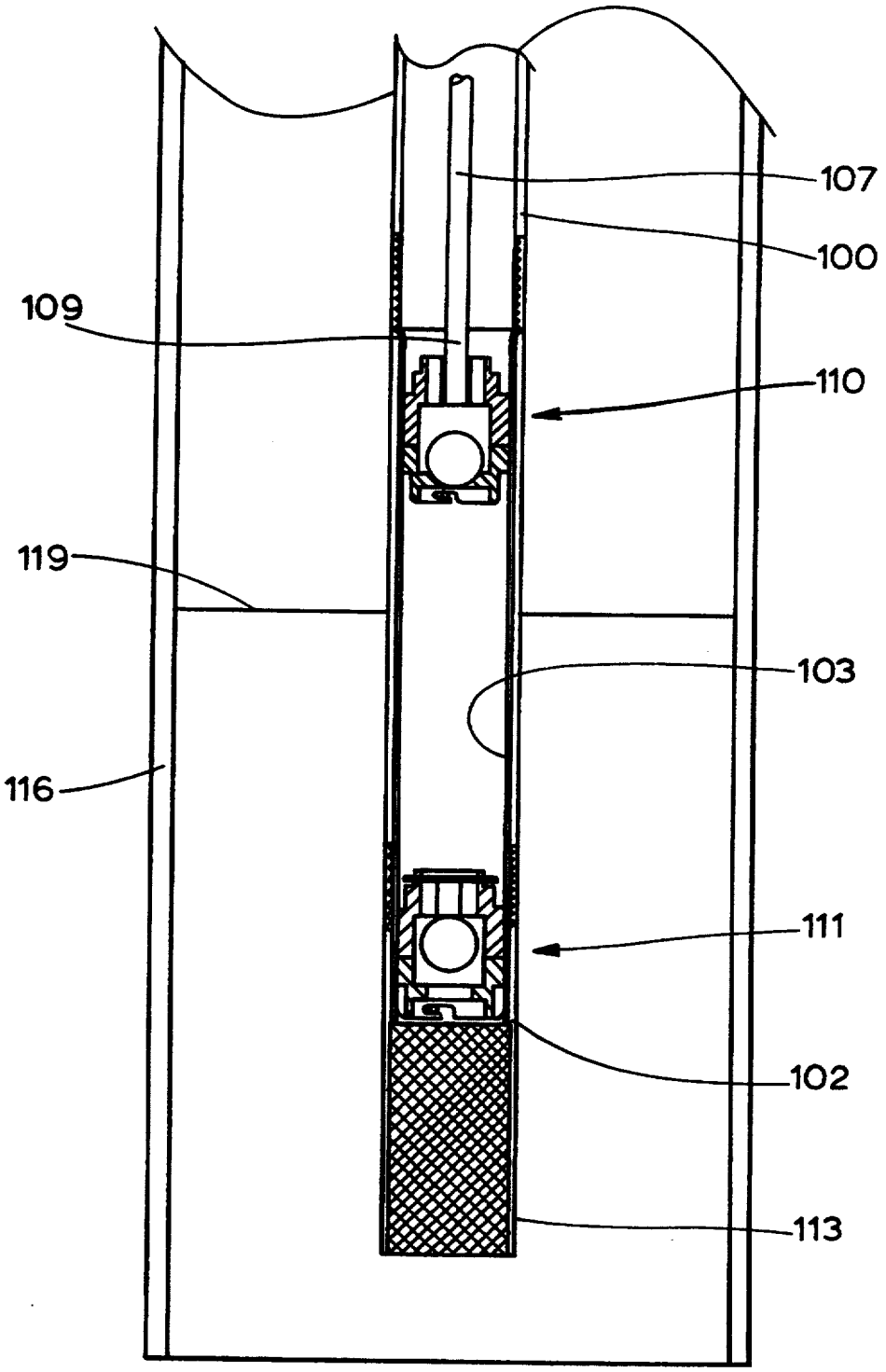
FIG. 1C is a partially elevated, partially cross-sectional side view of a lower portion of the device of FIG. 1B, enlarged to show detail.

The device of the present invention is useful for elevating liquid, such as groundwater or landfill leachate, through a well in a landfill or other geological site, e.g., for subsequent collection, analysis, consumption or disposal of the liquid. As shown in FIGS. 1A, 1B, and 1C, a hollow cylindrical casing or riser pipe 100 for channeling liquid is inserted into a well bore at the geological site, and includes an upper end 101 and a lower end 102. In preferred embodiments, a hollow casing liner or sleeve 103, for lining the casing 100 is disposed within the casing 100. The ends of both the casing 100 and the liner 103 permit liquid to pass through them during operation of the device. A discharge means or upper casing opening 104 is disposed near an upper end 101 of the casing 100 for removal of liquid from the casing. As shown in FIG. 1B, the upper casing opening 104 is connected to a horizontal tubular discharge conduit 105 having a discharge opening 106 through which the liquid elevated through the well with the device is removed from the device for subsequent collection, analysis, consumption, disposal, or the like. In an alternative embodiment, stationary valve unit 111 is disposed outside the riser pipe 100, sealably attached to the lower end 102 of the riser piper 100 or to the liner 103.

An actuating rod 107, also known as the drive rod, piston rod, or sucker rod, is shown axially disposed within the casing 100, the actuating rod 107 includes an upper end 108 and a lower end 109. A piston valve unit 110 is disposed within the casing 100 and connected to the actuating rod 107. The actuating rod 107 and the piston valve unit 110 together comprise the piston assembly of the device of the present invention for elevating liquid toward the upper casing opening 104.

A stationary valve unit 111 is disposed within riser pipe 100 and below the piston valve unit 110. The stationary valve unit 111 remains in a substantially fixed position relative to the riser pipe 100 during movement of the piston assembly. In preferred embodiments, wherein a casing liner 103 is employed, the valve units 110 and 111 are disposed within the liner 103, and the liner 103 is disposed within the riser pipe 100. The liner 103 and valve units 110 and 111, and particularly the lowermost stationary valve unit 111, preferably are disposed within the riser pipe 100 at its lower end 102. More than one piston valve unit 110 and/or more than one stationary valve unit 111 may be incorporated in the device. For reasons of cost and ease of construction, repair, and salvage, use of a single piston valve unit and single stationary valve unit is preferred. In an alternative embodiment, stationary valve unit 111 is disposed outside the riser pipe 100, sealably attached to the lower end 102 of the riser piper 100 or to the liner 103.

An actuator 112 is operatively connected to the upper end 108 of actuating rod 107. The actuator 112 can be a person, an animal, any electrical or mechanical device, or any combination thereof that is capable of imparting reciprocal vertical movement through actuating rod 107 to the moveable piston valve unit 110 of the device. As shown in FIG. 1B, a preferred actuator 112 is a mechanical, air-driven cylinder. Other preferred actuators include hydraulicly or electrically-driven cylinders. The actuator 112 is shown attached to the actuating rod 107 via removably engageable and compatible threaded connections on the upper end 108 of the actuating rod 107, and on an adapter 114 attached to actuator 112. Any suitable connecting means that will permit efficient transmission of vertical movement from the actuator 112 to the actuating rod 107 may be employed. A preferred air-driven, hydraulic, or electric cylinder is a top-mounted, self-reciprocating, fixed-travel cylinder with an adjustable cycle rate, such as an Allenair Self-Reciprocating Model AV 3×7 VCR WR CS (Allenair Corp., Mineola, N.Y. 11501). The Aro Corporation, Air Fluid Products Division (Bryan, OH 43506) produce a number of pneumatic cylinders (single and double-acting with tang) that are preferred actuators (e.g., Series 23, 24, 25, 27, 28, 29—1⅛"to 4") for devices of the present invention. Variable-travel cylinders may also be employed, but are more expensive and less readily available commercially. A cylinder having a fixed cycle rate may also be employed. However, an adjustable cycle rate advantageously permits the user to vary the rate at which the device elevates liquid from a well. Such considerations may be important in applications where the user wishes to remove liquid at a rate such that a specified level of liquid remains within the well, rather than completely draining the well.

It will be apparent that the cylinder actuator 112 has moving elements that impart vertical movement to the actuating rod 107, and has stationary elements, including a housing, in which the moving elements are housed. For the moving elements of the air cylinder actuator 112 to efficiently impart vertical movement to the actuating rod 107, relative to the riser pipe 100, the housing of the air cylinder should be maintained in a substantially stationary position relative to the riser pipe 100 of the device. The substantially stationary position is preferably maintained by mounting the actuator 112 to a stable support at the surface of the geological site. The actuator 112 may, for example, be mounted to the casing 100 by way of a mounting bushing 115 (as shown in FIG. 1B); to the discharge conduit; to a well casing into which the device of the present invention has been inserted; or to an external riser structure that one assembles at the surface of the geological site, e.g. to provide a stable base for workmen and to cover and protect the well.

The top-mounted actuator 112 has the advantage of being easily removable and/or replaceable with minimal disturbance to other elements that comprise the device of the present invention. A single top-mounted actuator 112 means easily can be installed, operated, and removed from multiple devices in a single geological site, rather that requiring a dedicated actuator for each device. Also, subsurface shifting in a geological site that results in the loss or destruction of subsurface components of a device installed in a well will not result in the loss of a top-mounted actuator 112, because a top-mounted actuator is disposed above the surface S of the geological site. A top-mounted actuator 112 preferably is disposed above the discharge opening 106 to prevent cross-contamination between the actuator 112 and the liquid being elevated during operation of the device. A cover (not shown) having an aperture through which the actuating rod passes may be incorporated above the upper casing opening 104 to protect the actuator from the liquid, and also to prevent contamination of the well from the surface of the geological site. In the embodiment of FIGS. 1A–1C, mounting bushing 115 protects actuator 112 from liquid that is elevated during operation of the device. A cover for discharge opening 106 may also be provided.

In a preferred dual casing embodiment, casing 100 of the device is assembled within a well casing 116 that is first installed in a well. Above the surface S of the geological site, a well cap 117 is attached to or placed upon well casing 116 to prevent contamination of the well from the surface and, if desired, to prevent escape of gases from the well. Casing 100 passes through a bore in well cap 117 to permit operation of the device and repair of the device (as described below) without removal of the well cap. One or more annular flanges 118 may be secured to well cap 117 (e.g., with bolts, glue, or the like) to form a sealing engagement with and to stabilize casing 100 relative to well casing 116. An advantage of the dual casing embodiment is that it permits smooth, nonlaminated gas flow, retrieval, and measurement of gases from the geological site (e.g., methane gas from a landfill). For example, where the level of liquid 119 in the well is maintained above the lower end 102 of casing 100, gases in the well will rise above the liquid level 119 and may be passively collected or pumped from the well casing 116 through a discharge conduit above the surface of the geological site. Optionally, discharge opening 106 of casing 100 is sealably engaged to a first discharge opening in well casing 116, and gases are collected through a second, distinct opening in well casing 116 (not shown). As shown in FIG. 1B, the Same discharge opening in well casing 116 may be used to recover both gases from the well and liquid from horizontal tubular conduit 105. Because liquid and gas are raised essentially through separate conduits—liquid is raised within casing 100 and gases within well casing 116—the dual casing embodiment gives better gas flow readings and smoother, enhanced gas recovery with less turbulence than conventional pumping devices.

Shown disposed below the valve units is a screen 113, or other filtering means, for preventing debris from contacting the valve units 110 and 111 while permitting liquid to flow into the device during operation of the device. The screen 113 is attached to the lower end 102 of the casing 100, but can be integrated into the device elsewhere, e.g. attached to liner 103 or to stationary valve unit 111, and achieve the same function. More than one screen may be employed. To prevent debris from clogging the casing 100 or the valve units 110 and 111, a screen 113 is preferably employed at the lowermost end, or liquid entrance of the device. The screen 113 should have pores or openings to permit liquid to freely pass into the device and to prevent the passage of gravel or other debris that would be encountered at the bottom at the well in the geological site. A screen 113 can be constructed, for example, from commercially available sturdy wire screening, and can be attached to the device by conventional attachment means known in the art.

Figure 2A:
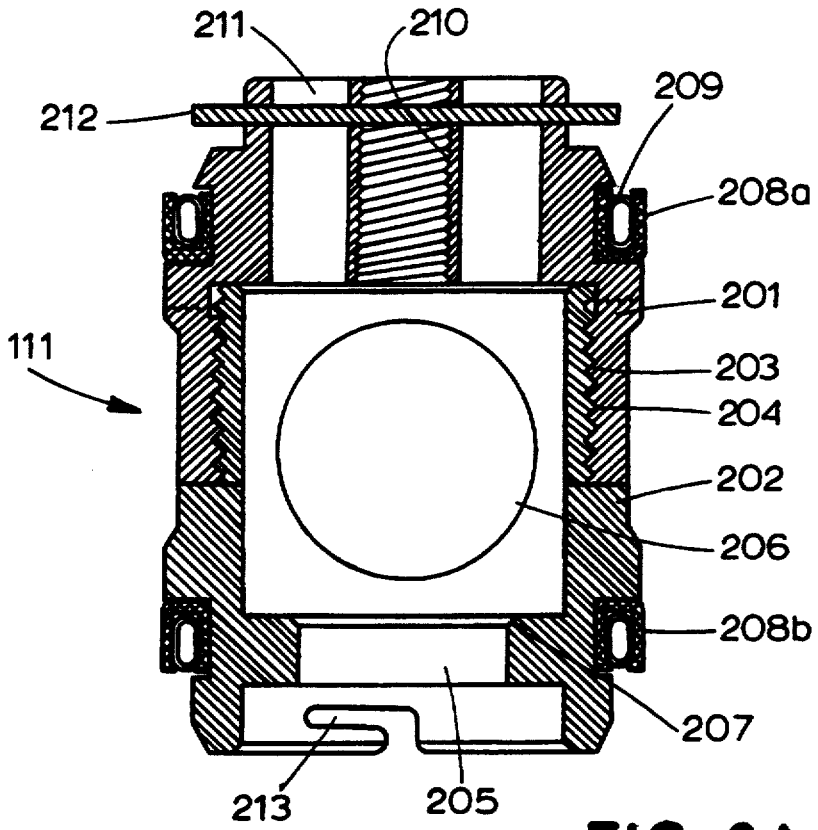
FIG. 2A is an enlarged, largely cross-sectional view of one embodiment of a valve unit forming part of the device.

Since FIGS. 1A-1C show a preferred embodiment wherein the piston valve unit 110 and the stationary valve unit 111 are identical in design, FIG. 2A is representative of either such valve unit 110 or 111, except as noted below. Construction and repair costs of the device are reduced by designing and employing a valve unit that functions as both a piston valve unit 110 and as a stationary valve unit 111. For example, on-site replacement of a valve unit 110 or 111, as described below, is facilitated by using identical units 110 and 111.

Figure 2B:
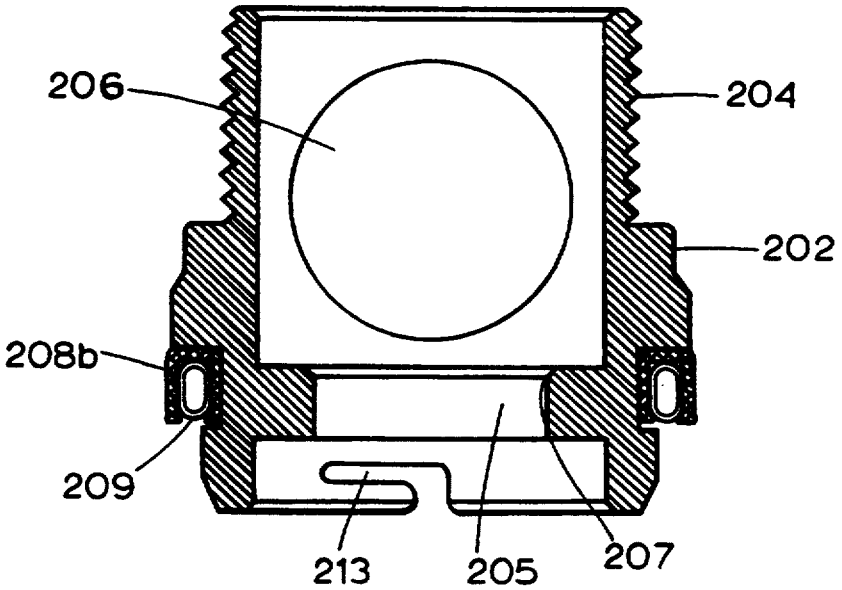
FIG. 2B is an enlarged, largely cross-sectional view of the valve unit of FIG. 2A, with an upper portion of the valve casing and an upper annular sealing ring removed.
Figure 2D:
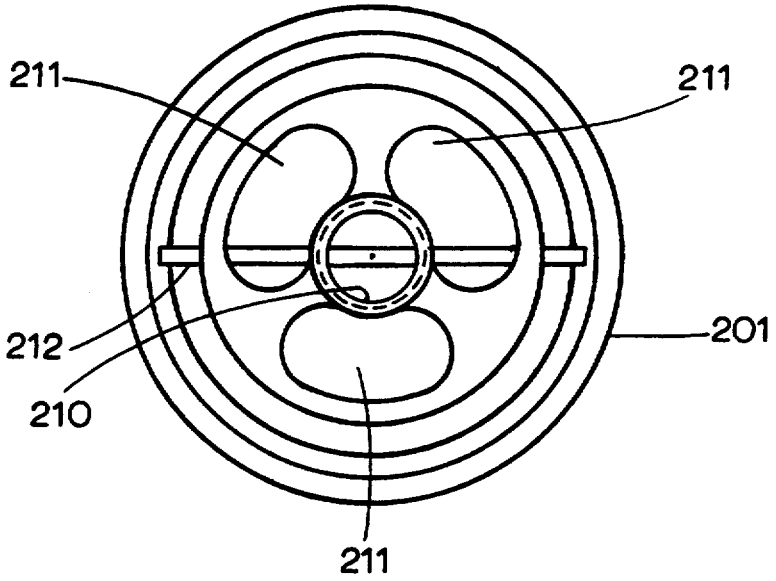
FIG. 2D is a top view of the upper portion of a valve unit valve casing of the valve unit depicted in FIG. 2A.
Figure 2C:
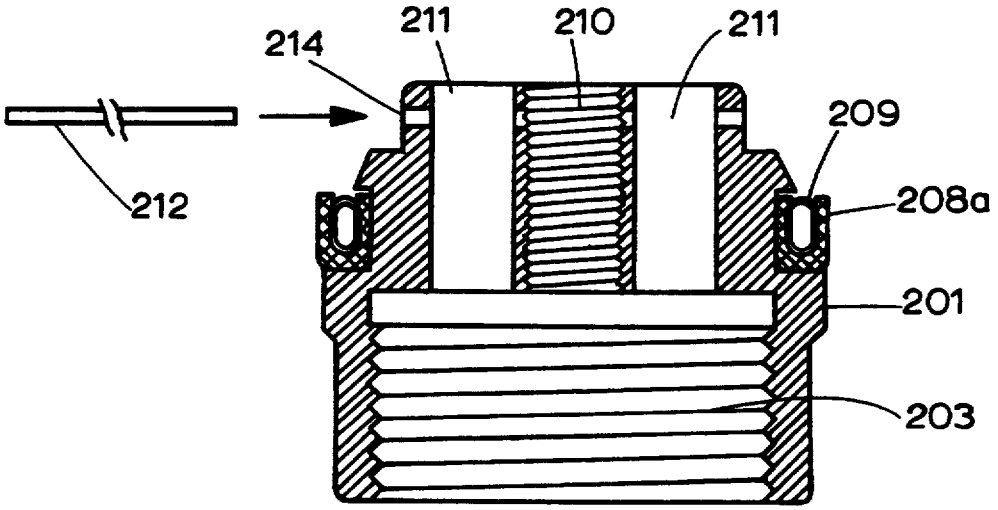
FIG. 2C is a cross-sectional view, partially exploded, of an upper portion of the valve casing and upper annular sealing ring of the valve unit depicted in FIG. 2A.
Figure 2E:
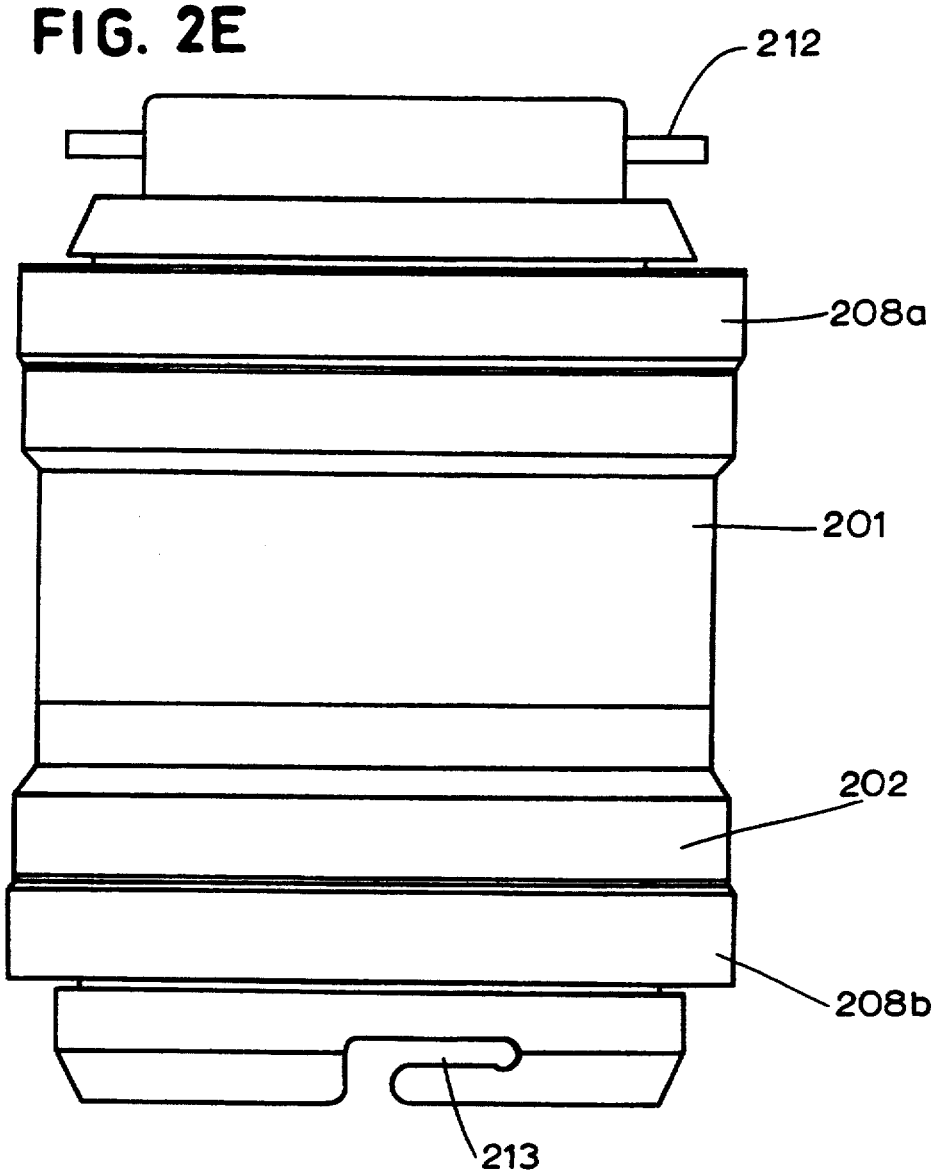
FIG. 2E is an elevational view of the valve unit depicted in FIG. 2A.

In an embodiment shown in FIGS. 2A and 2E, the valve units 110 and 111 include a valve casing constructed from an upper valve casing portion, or valve cap 201, connected to a lower valve casing portion, or valve seat 202, by axially-aligned compatible cylindrical threaded portions 203 and 204. An aperture 205 is disposed within the valve casing of each valve unit 110 and 111. Each valve unit 110 and 111 further includes a valve structure for permitting liquid to flow through the valve unit aperture 205 toward the discharge opening 106, and for preventing liquid from flowing through the valve unit aperture 205 away from the discharge opening 106. A preferred valve structure is a ball valve comprising a ball 206 and an annular, beveled valve seating 207 integral with the valve casing and circumscribing the aperture, for sealing engagement of the ball 206. Each valve unit further comprises sealing means for preventing liquid communication around an outer periphery of the valve casing during operation of the device. A preferred sealing means is one or more removable annular sealing rings or elastomeric O-rings **208*a* and 208*b* circumscribing the periphery of the valve units 110 and 111. Upper annular sealing ring 208*a* operates to prevent liquid communication around an outer periphery of the piston valve unit valve casing during upward motion of the piston assembly, and lower sealing ring 208*b* operates in the same manner during downward motion of the piston assembly. Use of two spaced sealing rings prevents lateral movement or wobble of the valve units 110 and 111. An annular support ring 209 may optionally be included in such annular sealing rings 208*a* and 208*b* to improve the seal quality during operation of the device. The annular sealing rings 208*a* and 208*b* form a sealing engagement with the liner 103 of the assembled device and thereby prevent liquid communication around the outer periphery of the valve units 110 and 111. In an embodiment wherein no liner 103 means is employed, the outer dimensions of the valve units 110 and 111, and the thickness of the sealing rings 208*a* and 208*b* are chosen such that the sealing rings sealingly engage the casing 100**.

Axially disposed threads 210 in an upper portion of valve unit 110 and 111 are shown in FIG. 2A that, together with compatible threads on the lower end 109 of actuating rod 107, form a preferred means for attachment of the actuating rod 107 to the piston valve unit 110 to form the piston assembly. In the preferred embodiment, wherein the stationary valve unit 111 is disposed below the piston valve unit 110, it will be appreciated that threads 210 on the stationary valve unit 111 will not effect operation of the device, and moreover may be useful as interconnection structure for reversibly connecting the piston assembly to the stationary valve unit 111 for the purpose of removing the stationary valve unit 111, as explained in more detail below.

Operative assembly of the valve unit 110 or 111 shown in FIG. 2A is achieved by axial rotation of upper valve casing portion 201 with respect to lower valve casing portion 202, to engage or disengage compatible threaded portions 203 and 204. As shown in FIG. 2B, the ball 206 is easily placed into the valve seating 207 prior to engagement of the upper valve casing portion 201 and lower valve casing portion 202.

FIG. 2C is a vertical cross-sectional view of the upper portion 201 of the valve casing depicted in FIG. 2A. The upper valve casing portion 201 serves to retain the ball 206 within the valve casing when liquid is flowing through the valve unit 110 or 111 toward the discharge opening 106, relative to the position of the valve unit. One or more outlets 211 in the upper valve casing portion 201 facilitate the flow of liquid through the valve unit 110 or 111 toward the discharge opening 106, relative to the position of the valve unit. One of many possible arrangements for outlets 211 in the upper portion 201 of the valve casing is shown in FIG. 2D.

Each valve unit 110 or 111 directly contacts liquid being elevated through a well with the device. Thus, the valve units are constructed from materials that are resistant to corrosion by, or cross-reactivity with, the liquid, and preferably chemically inert with respect to the liquid. For the valve casing, polytetrafluoroethylene (PTFE) and stainless steel are preferred construction materials. Stainless steel is more preferred for its strength and durability. A stainless steel valve casing with threads 210 has been found to form a stronger threaded connection with an actuating rod 107 than a similar casing made from PTFE. Stainless steel and PTFE are also preferred materials for constructing ball 206. Other suitable materials for the valve casing or ball, such as industrial ceramics, chemically resistant organic polymers, or metallic alloys, will be apparent to one of ordinary skill, depending on the application for which the device is to be used. Preferred sealing rings **208*a* and 208*b* are formed from a nitrile elastomer, a synthetic elastomer, or VITON. Optional annular support ring 209** is preferably formed from stainless steel.

Figure 2G:
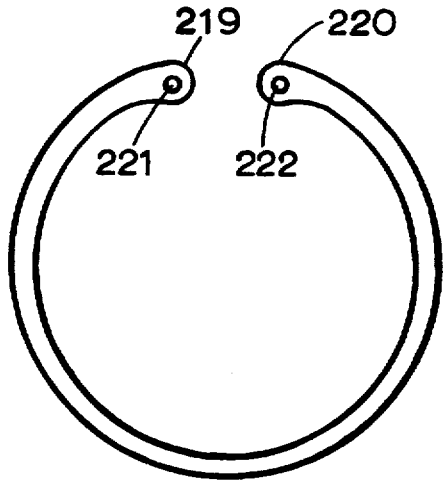
FIG. 2G is a top-view of an internal retaining ring forming part of the valve unit depicted in FIG. 2F.
Figure 2F:
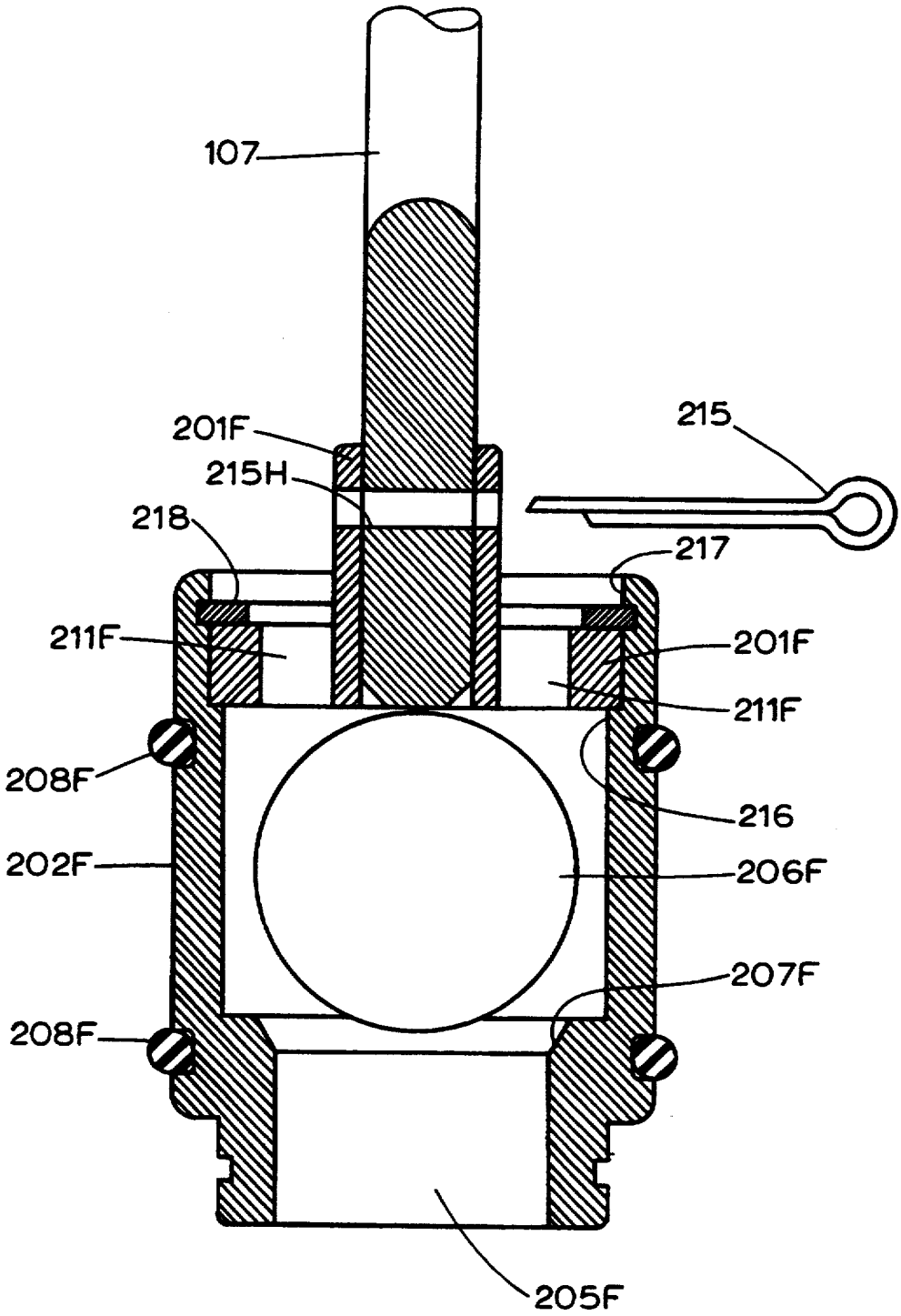
FIG. 2F is a cross-sectional view of an alternative embodiment of a valve unit forming part of the device.

An alternative embodiment of a ball valve unit 110 or 111 is depicted in FIG. 2F, that embodiment having an upper valve casing portion 201F and lower valve casing portion 202F, aperture 205F disposed within the valve casing, and a valve structure comprising a ball 206F and an annular, beveled valve seating 207F. Sealing rings 208F prevent liquid communication around an outer periphery of the valve casing during operation of the device. One or more outlets 211F in the upper valve casing portion 201F facilitate the flow of liquid through the valve unit toward the discharge opening 106. A cotter pin 215 passing through hole 215H in upper casing portion 201F and actuating rod 107 is shown as a means for attaching actuating rod 107 to upper valve casing portion 201F. Upper valve casing portion 201F rests upon inwardly projecting circumferential shoulder 216 of lower valve casing portion 202F and is retained beneath inwardly projecting circumferential shoulder 217 by internal retaining ring 218 (FIG. 2G). To assemble the valve unit, ball 206F is placed within lower valve casing portion 202F and upper valve casing portion 201F is placed upon shoulder 216. Ends 219 and 220 of retaining ring 218 are squeezed together, e.g., by means of a needle-nose pliers inserted into holes 221 and 222, and retaining ring 218 is placed above upper casing portion 201F and below shoulder 217 of lower casing portion 202F. Upon release of ends 219 and 220, retaining ring 218 expands outwardly and is retained by shoulder 217, thereby retaining upper casing portion 201F between shoulders 217 and 218.

Although a ball valve is the preferred valve structure for the valve units of the device of the present invention, any number of other valve structures may be employed, with the requirement that the valve structure permits liquid to flow through the valve unit aperture 205 toward the discharge opening 106, relative to the position of the aperture 205, and prevents liquid from flowing through the valve unit aperture 205 away from the discharge opening 106, relative to the position of the aperture 205.

FIGS. 1A-1C depict a preferred embodiment wherein the stationary valve unit 111 is disposed below the piston valve unit 110. Operative embodiments of the device may also be constructed wherein the piston valve unit 110 is disposed below the stationary valve unit 111. In such an embodiment, the axially disposed actuating rod 107 passes through the stationary valve unit 111. In such an embodiment, a ball valve such as that shown in FIG. 2A is unsuitable for the stationary valve unit 111. However, valve structures are known that are suitable for such an embodiment, e.g., the valve structures of pumps depicted in U.S. Pat. No. 4,669,536. In such an embodiment, it is necessary that during actuation of the piston assembly: a) the actuating rod 107 form a sealing engagement with the stationary valve unit 111, where the rod 107 passes through the stationary valve unit 111, to prevent liquid communication through the stationary valve unit 111 between the actuating rod 107 and stationary valve unit 111, and b) the stationary valve unit 111 remain in a substantially fixed position. It is contemplated that the valve units 110 and 111 of such an embodiment can still be removable as described below. This may be achieved, for example, by utilizing a stationary valve unit sealing means that forms a substantially tighter frictional engagement with the liner 103 or casing 100 than the sealing frictional engagement between the actuating rod 107 and the stationary valve unit 111. In this way, ordinary movement of the actuating rod 107 during operation of the device will not displace the stationary valve unit 111, but the piston assembly can be reversibly engaged with the stationary valve unit 111, as described below, to remove and later to reinsert the stationary valve unit 111. To prevent downward movement of the stationary valve unit 111 in such an embodiment, e.g. from the weight of liquid above the stationary valve unit 111, the stationary valve unit 111 may be made larger than the piston valve unit 110 such that the piston valve unit 110 is disposed within a liner 103, whereas the larger stationary valve unit is disposed within the casing 100 above the liner. The top of the liner thereby serves as a stationary valve unit retainer for preventing downward movement of the stationary valve unit 111.

To remove liquid from a well with the device, the lower end of the device is inserted into the well. Preferably, the lower end 102 of the casing 100 is lowered to a depth such that pressure in the well external to the device is sufficient to force liquid through the bottom of the device and through the aperture 205 of the lowermost valve unit.

Reciprocal up-and-down movement of the piston assembly results in liquid being raised through the casing 100 until it passes through the discharge opening 106. During the downstroke of the piston assembly, liquid flows through the aperture 205 of the piston valve unit 110 toward the discharge opening 106—relative to the downwardly-changing position of the piston valve unit aperture 205. Also during the downstroke, the ball valve of the stationary valve unit 111 prevents liquid from flowing through the stationary valve unit aperture 205 away from the discharge opening 106, relative to the position of the stationary valve unit aperture 205, which is substantially fixed. During the upstroke of the piston, liquid flows through the stationary valve unit aperture 205 toward the discharge opening 106, relative to the position of the stationary valve unit aperture 205, which remains substantially fixed. Also during the upstroke, the ball valve of the piston valve unit 110 prevents liquid from flowing through the piston valve unit aperture 205 away from the discharge opening 106, relative to the upwardly-changing position of the piston valve unit aperture 205. Repeated raising and lowering of the piston assembly results in the elevation of liquid up through the casing 100 to the discharge opening 106, where the liquid can be collected, analyzed, used, treated, or the like. In preferred embodiments, wherein the stationary valve unit 111 is disposed near the lowermost end of the device, the device may be operated to remove substantially all liquid from the well. Moreover, an advantage of the device over certain conventional devices is that the level of liquid in the well does not require monitoring in order to safely operate the device.

Figure 4A:
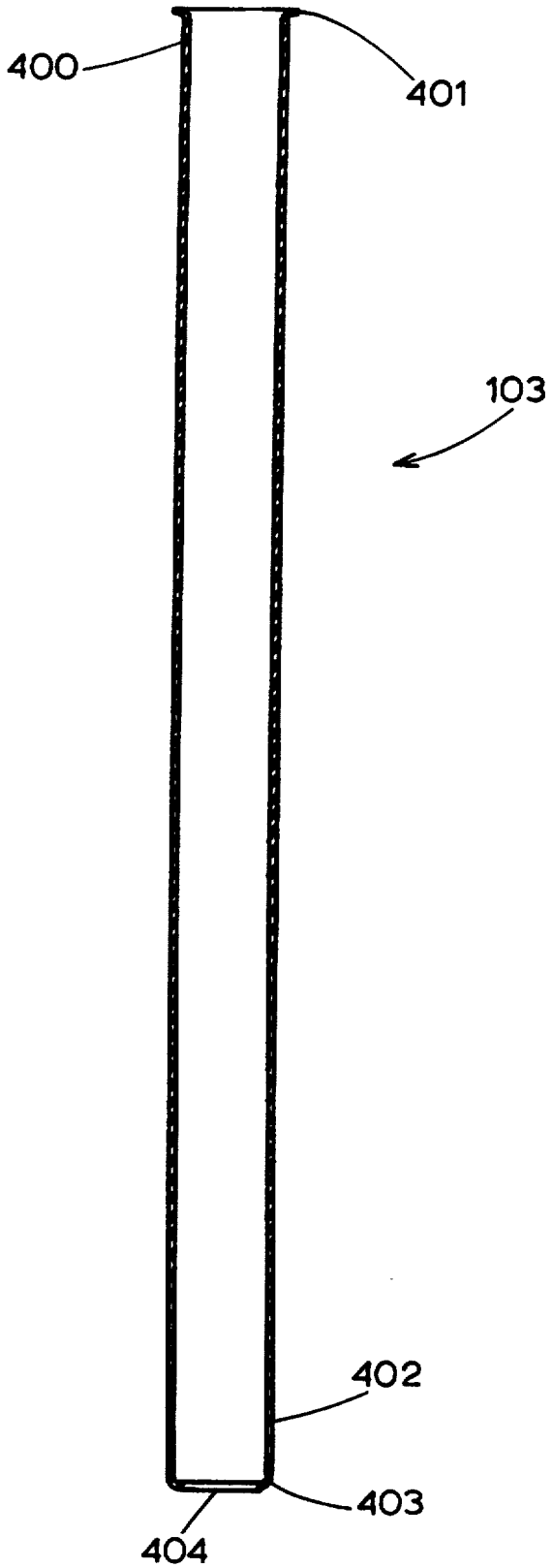
FIG. 4A is a cross-sectional side view of an embodiment of a liner that is part of a preferred embodiment of the device of the present invention.

The novel tubular liner 103 for lining the casing 100 offers a number of advantages over prior art devices that are apparent from the description which follows. Referring to FIG. 4A, in a preferred embodiment, a lower end 402 of the liner 103 preferably includes a valve unit retainer or inwardly flared end 403 for preventing downward movement of a valve unit 110 or 111 past the lower end of the device. In preferred embodiments, where the stationary valve unit 111 is the lowermost valve unit, such valve unit retainer 403 serves to retain the stationary valve unit 111 in a substantially fixed position relative to the casing 100 during movement of the piston assembly. For example, the valve unit retainer 403 prevents the stationary valve unit from being forced out of the lower end 402 of the liner 103 e.g. by the weight of the liquid above the stationary valve unit or by accidental dislodging by the piston assembly. The sealing rings **208*a*, 208*b* of the stationary valve unit 111 ordinarily will provide a sufficient frictional engagement with the liner 103 to prevent upward movement of the stationary valve unit 111 relative to the casing 100 means during movement of the piston assembly. Preferably, the lower end 402 of the liner 103 is flared radially inward to create the inwardly projecting annular flange 403 that is a suitable valve unit retainer. Optionally, a screen or other filtering means 404 (FIG. 4A) that prevents debris from contacting the valve units 110 and 111 of the device, is attached to or integral with the liner 103 and may serve as a valve unit retainer instead of, or in addition to, retainer 403. The retainers 403 or 404 described above are preferred valve unit retainers because each permits upward movement of the stationary valve unit 111 and thereby facilitates removal of the stationary valve unit, in the manner described below, for repair or replacement. Other valve unit retaining means, such as fasteners, e.g., screws, will be apparent to one of ordinary skill. In an embodiment without a liner 103, a valve unit retainer is preferably provided attached to or integral with the lower end 102 of the casing 100. In an embodiment with a liner, the valve unit retainer may be attached to or integral with the casing 100, disposed such that the lowermost valve unit 110 or 111 is retained within the liner 103**.

Because in preferred embodiments, the liner, or sleeve 103, is disposed with the casing, or riser pipe 100, the liner 103 preferably has an outer diameter substantially equal to the inner diameter of the casing 100, to minimize vibration of the liner 103 within the casing 100 during operation of the device. The outer diameter of the liner 103, however, desirably is small enough to be slidably inserted into a section of the casing 100. The outer diameter of the liner 103 also should be sufficiently small such that expansion of the liner 103 caused, for example, by heat from the liquid to be pumped from the well, will not cause excessive outward stress on the casing 100 that could crack the casing. It should be understood that the device of the present invention can be constructed with liner 103 disposed below riser pipe 100 with the upper end 400 of liner 103 sealably attached to lower end 102 of riser pipe 100.

The liner 103 functions to protect the casing 100, which preferably is formed from an organic polymer, from abrasion or wear caused by insertion, operation, or removal of the piston valve unit 110. The liner 103 should be constructed of a wear-resistant material to minimize wear caused by movement of the piston valve unit 110 within the liner 103 during operation of the device. The liner 103 contacts liquid being elevated by the device, and preferably is resistant to and non-reactive with such liquid. Further, the sealing rings **208*a* and 208*b* of the valve units must maintain sealed engagement with the inner surface of the liner 103, to prevent liquid communication around an outer periphery of the casings of the valve units 110 and 111 during operation of the device. The liner 103 and sealing rings 208*a* and 208*b* should be constructed of compatible materials for imparting an effective seal. For all of these reasons, and for reasons of machinability, stainless steel is a preferred material for construction of the liner 103. Other suitable materials will be apparent to one of ordinary skill. For particularly caustic liquids, it may be desirable to coat the inner surface of the liner 103** with an inert organic polymer, such as PTFE.

The liner 103 preferably remains substantially stationary during the up-and-down movement of the piston valve unit 110. However, because of the sealing engagement between the liner 103 and piston valve unit 110, friction between the sealing rings **208*a* and 208*b*, of the piston valve unit, and the liner 103 has the tendency to pull the liner 103 in the direction of movement of the piston valve unit 110. Therefore, a lining retainer preferably is provided to retain the liner 103 sleeve in a substantially fixed position within the casing 100 during actuation of the pump. In the preferred embodiment shown in FIG. 4A, an upper end 400 of the liner 103 is flared radially outward to create an annular flange 401. This annular flange 401 serves as a novel lining retainer between two sections of casing 100**, as described in more detail.

Figure 4B:
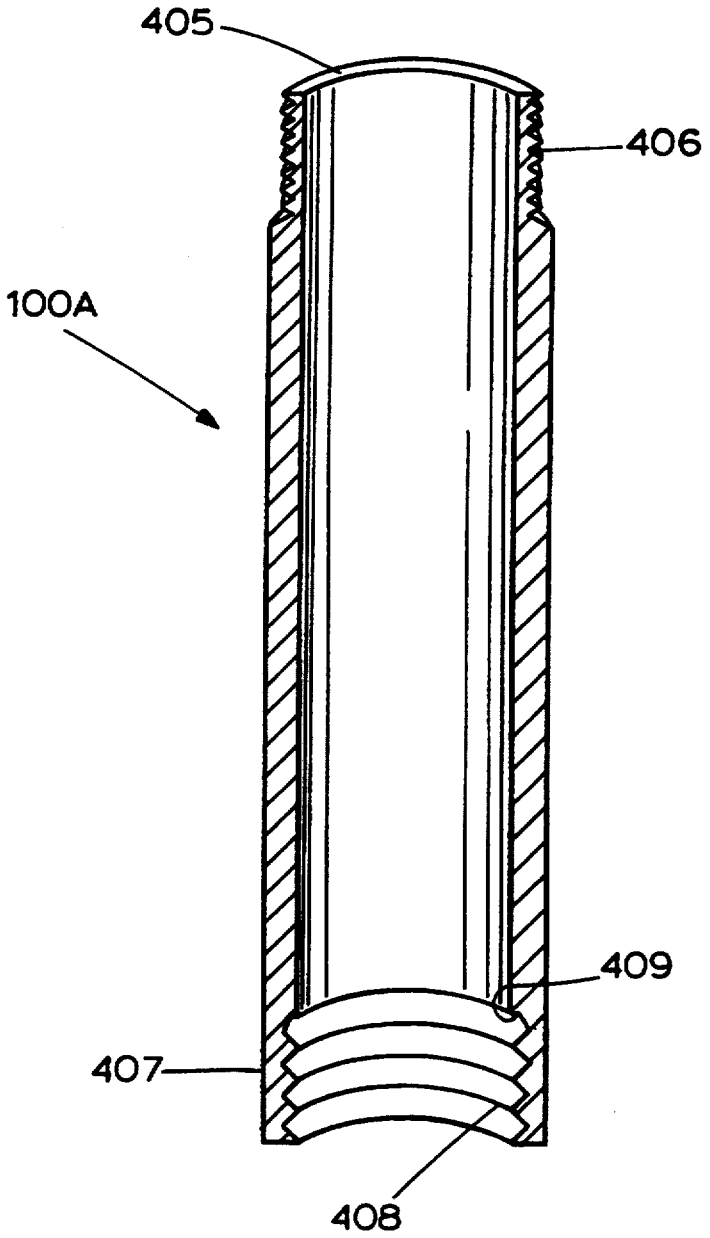
FIG. 4B is a broken-away perspective view of a portion of piping used to form the casing of a preferred embodiment of the device.

The casing or riser pipe 100, preferably is constructed from a plurality of casing portions, or sections 100A (FIG. 4B), of commercially available piping, as explained in more detail below. As shown in FIG. 4B, in preferred embodiments each section 100A of the casing 100 has one end 405 having integral male-threads 406 and an opposite end 407 having integral female-threads 408 for attachment to compatible threaded ends of additional sections 100A of the casing 100. The male-threaded end 405 of the casing section 100A forms a circumferential shoulder. Similarly, above the female-threads 408, internally within the casing section 100A, is an inwardly-projecting circumferential shoulder 409. In the preferred embodiment, sections 100A of the casing 100 are attached end-to-end via the above-described compatible male-female threaded ends to create a casing 100 of any desired length.

Figure 4C:
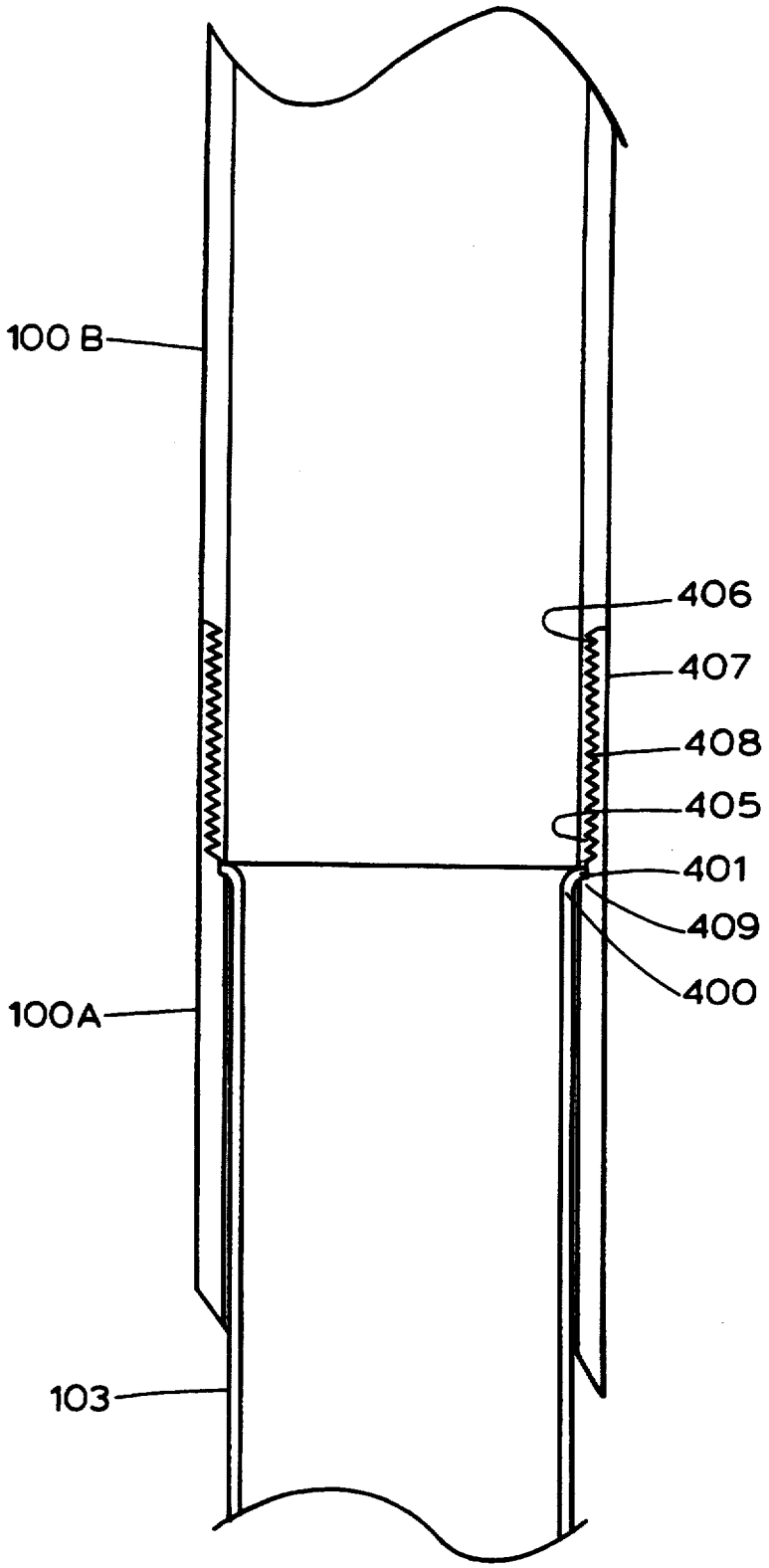
FIGS. 4C and 4D are enlarged, partially broken-away, cross-sectional views of a portion of a device of the present invention. These figures depict preferred embodiments for retaining a liner within a casing of the device.

Referring to FIG. 4C, the outer diameter of the upper, outwardly flared annular flange 401 of liner 103 is sufficiently small to pass freely through the internal threads 408 of the female-threaded end 407 of a section 100A of casing 100, but sufficiently large to be retained above the inwardly projecting circumferential shoulder 409 of the same section 100A of casing 100. To assemble the device, the lower end 402 (shown in FIG. 4A) of liner 103 is slidably inserted into an upwardly-oriented female-threaded end 407 of the lowermost (first) section 100A of casing 100 until annular flange 401 comes to rest on and is retained by the inwardly projecting circumferential shoulder 409 of the first section 100A of the casing 100. Shoulder 409 prevents substantial downward movement of the liner 103 during actuation of the completely-assembled pump.

Referring still to FIG. 4C, the male-threads 406 on a lower end 405 of a second section 100B of casing 100 then is attached to the compatible, female-threads 408 of the first, liner-containing section 100A of the casing 100. Upon tightening of the threaded joint between the sections 100A and 100B of casing 100, the circumferential shoulder of the male-threaded end 405 of the second section 100B of casing 100 will come to rest atop annular flange 401 of liner 103. Thus assembled, the male-threaded end 405 of the second section 100B of casing 100 prevents the liner 103 from substantial upward motion during movement of the piston valve unit 110. Moreover, this interconnection of the adjacent sections 100A and 100B of casing 100 surrounding the outwardly flared annular flange 401 of the liner 103 prevents liquid that is being pumped up through the device toward the discharge opening 106 means from leaking back down into the well between the outer surface of the liner 103 and the inner surface of the lowermost section 100A of casing 100.

Figure 4D:
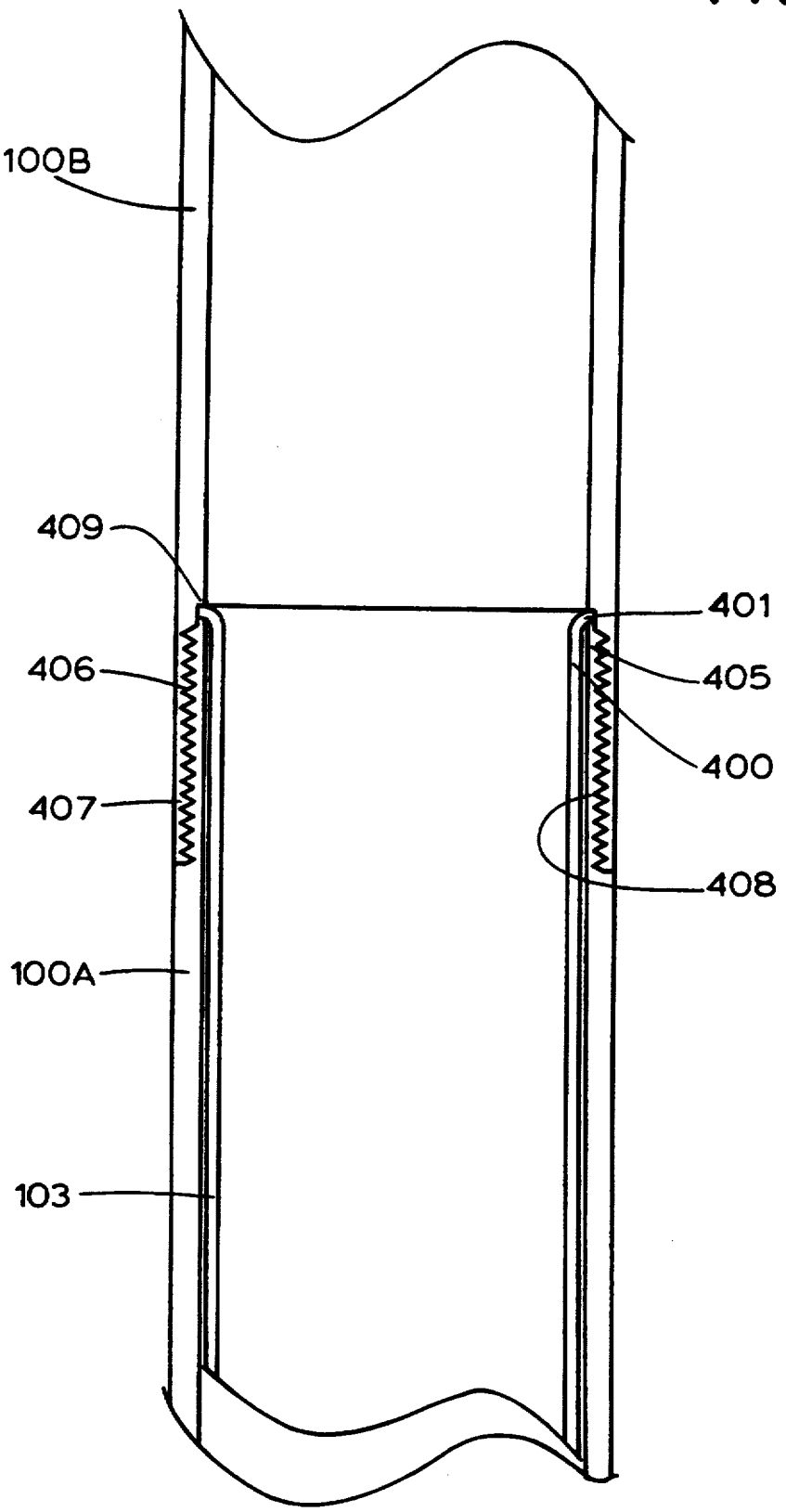

FIG. 4D depicts an alternative embodiment wherein the male threads 406 of casing sections 100A and 100B are oriented such that the threads are below the end 405 forming a circumferential shoulder. In such an embodiment, the outwardly projecting annular flange 401 of liner 103 is disposed above both the male-threads 406 and the circumferential shoulder of end 405 of the first section 100A of casing 100, and below inwardly projecting circumferential shoulder 409 in the female-threaded end 407 of a second section 100B of casing 100. It will also be apparent that the device can operate effectively if additional sections of casing 100 are attached below the liner-containing section of casing 100. However, in the preferred embodiment, the liner 103 is disposed in the lowermost section 100A of casing 100 and has a length substantially equal to the length of section 100A of casing 100, such that the lower end 402 of the liner 103 is disposed at the lower end 102 of the casing 100. Because the piston valve unit 110 is disposed within the liner 103, the length of the liner 103 should exceed the length through which the piston valve unit 110 moves, so that the piston valve unit 110 remains within the liner 103 during operation of the device. When a preferred model air-driven cylinder actuator 112 is employed which has a 7 inch piston stroke, the liner 103 and the lowermost section 100A of casing 100, preferably have a length of about 30 inches. When the device is designed to have a piston stroke that is substantially shorter than the length of the liner 103, the vertical position of the piston valve unit 110 can be adjusted to provide vertical movement of the piston valve unit 110 within the liner 103 over a different portion of the liner 103. In this way, if a portion of the liner 103 becomes worn by the piston valve unit 110 from operation of the device, the useful life of the liner 103 may be extended. For example, the vertical position of the piston valve unit 110 can be adjusted with respect to the liner 103 by adding or removing a section of casing 100 or, alternatively by adding or removing a section of actuating rod 107. Longer sections of casing 100 are preferred to construct that portion of the casing 100 above the sleeve, to reduce the number of sections needed to construct the device.

In an alternative embodiment (not shown), one or more elastomeric O-ring or other sealing devices may be provided around the external surface of the liner 103. Upon insertion of the liner 103 into the lowermost section 100A of casing 100, such O-rings will engage the liner 103 within the casing 100 to further prevent vibration and to prevent liquid communication between the outer surface of the liner 103 and the inner surface of the casing 100. If the liner 103 has no other lining retainer, the sealing O-rings may be chosen to create sufficient friction between the liner 103 and the casing 100 to prevent movement of the liner 103 relative to the casing 100 during actuation of the pump.

Figure 4G:
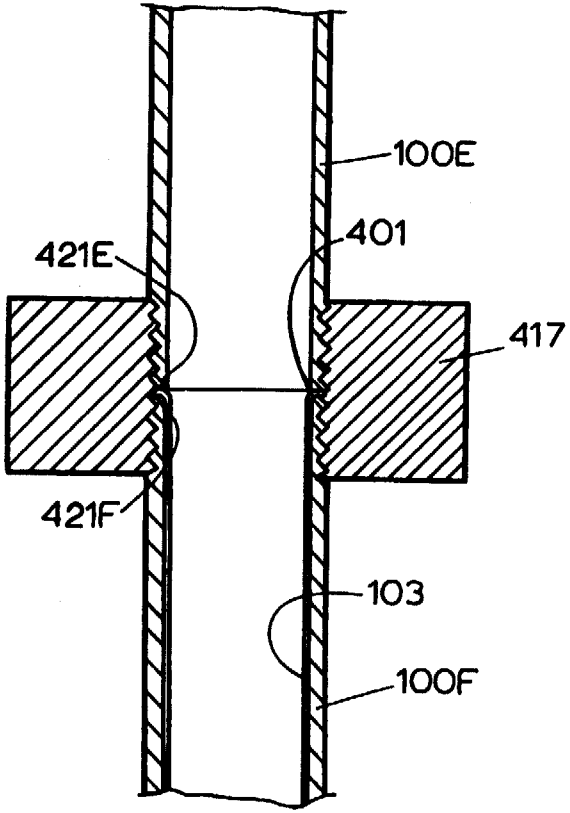
FIG. 4G is a partially broken-away, cross-sectional view of a portion of a device of the present invention depicting a preferred embodiment for retaining a liner within a casing of the device.
Figure 4F:
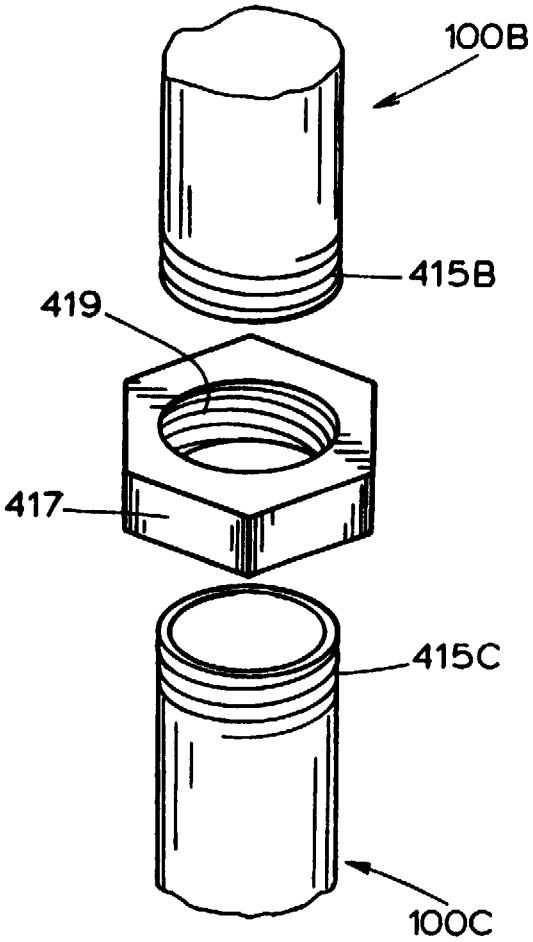
FIG. 4F is a partially broken-away perspective view of two portions of piping and a threaded coupling for joining the portions of piping together to form the casing of a preferred embodiment of the device.
Figure 4E:
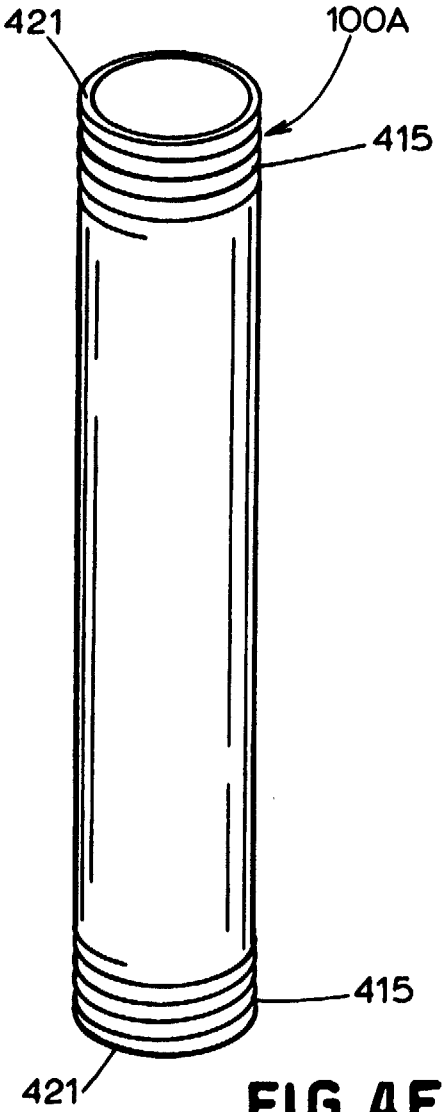
FIG. 4E is a perspective view of a portion of piping used to form the casing of a preferred embodiment of the device.

FIGS. 4E, 4F, and 4G depict another preferred embodiment wherein the casing 100 is constructed from a plurality of commercially-available straight-threaded sections 100A of piping having threading 415 at each end. Sequential casing sections 100B, 100C are coupled with a threaded coupling 417 having threads 419 compatible with the threads 415B and 415C of casing sections 100B and 100C. In this embodiment, liner 103 is slidably inserted into a first section 100F of casing 100. Annular flange 401 comes to rest and is retained on the circumferential shoulder formed by the end 421F of the first section 100F of casing 100. The lining 103 is further retained by the end 421E of a second section 100E of casing 100 that is coupled to the first section 100F with threaded coupling 417. A casing 100 of any desired length is created by coupling additional sections 100A to the casing with additional couplings 417.

An advantage of the present device is the ease and low cost in terms of materials and time needed to assemble the device. In a preferred embodiment, a well with a well casing is created by means known in the art at the geological site in which the device is to be installed, and the casing 100 of the device is installed within the well casing. The outer diameter of the casing 100 should be sufficiently small to easily pass down through the bore of the well casing. A smaller diameter casing 100 (e.g., about 1-2 inches) is preferred because a smaller diameter casing facilitates efficient installation in wells. Moreover, for a device of any given length, the weight of liquid within the device above the piston valve unit 110 and below the discharge opening 106 is less when the diameter of the casing 100 is smaller. Consequently, less power is required to actuate the piston assembly and a less expensive actuator 112 means may be employed.

A casing material should be chosen that will withstand any anticipated high temperatures and chemically reactive characteristics of the liquid to be elevated with the device. For certain applications it will be important that the casing 100 and all other elements that contact the liquid be inert, such that the device does not alter or contaminate the chemical composition of the liquid being retrieved from the well. Numerous piping materials are known in the art and one skilled in the art is capable of choosing a material for a particular application. For the aforementioned reasons and for reasons of cost and ease in assembly, repair and recovery, a preferred material for casing 100 is commercially available flush-joint (or threaded and coupled) 1.25" I.D. organic polymer piping. Polyvinyl chloride (PVC) piping is lightweight and can withstand temperatures of 120° F. or more. High density polyethylene (HDPE) piping also may be employed. For applications such as the removal of landfill leachate, where the leachate to be removed may reach temperatures of 80°-200° F., commercially available chlorinated polyvinyl chloride (CPVC) piping is preferred. Though heavier and more expensive, stainless steel piping may be used effectively and may be preferable in wells of greater depths. Fiberglass pipe also may be used. Continuous irrigation hose tubing or the like may be preferred for some applications. In such applications, the liner 103 is sealably attached to the lower end of a continuous length of tubing, either within the tubing or at the lowermost end of the tubing.

The commercially available piping materials contemplated for use in forming the casing 100 are available in different lengths, and a casing 100 can be constructed at the well site by lowering one section 100A of the casing 100 into the well casing, attaching a second section 100B of casing 100 to the top of the first section 100A using the male-female threading common on such piping, and repeating this process until a casing 100 of the desired length has been created within the well casing. In well casings having an inner diameter greater than the outer diameter of the casing 100, the well bore can also be used for other purposes, e.g., the insertion of probes to monitor liquid level, temperature, or the like in the well; or the insertion of a device for removal of gases from the geological site. When a casing 100 of the desired length has been assembled in a well, a discharge conduit 105, having a discharge opening 106 is preferably included in the upper end 101 of the casing 100, as shown in FIG. 1B.

For convenience, a number of components of the device are preferably assembled prior to insertion of the first section 100A of casing 100 into the well. As explained above, in preferred embodiments wherein a liner 103 is employed, the liner 103 is slidably inserted into the first section 100A of casing 100 prior to attachment of a second section 100B of casing 100. Additionally, it is easiest to slidably insert the stationary valve unit 111 into the bottom of the liner 103 prior to complete construction of the casing 100, though a stationary valve unit 111 later can be reversibly connected to the piston assembly for subsequent insertion into the casing 100, and disconnection from the piston assembly, as described below. Also, one or more screens, or other debris filtering devices, can be for incorporated into the device below the stationary valve unit at this time, for preventing debris from contacting the valve units 110, 111 of the device. For example, screen 404 may be attached to the liner 103 (FIG. 4A); screen 113 may be attached to the casing 100 (FIG. 1C); or a screen may be attached to the bottom of the stationary valve unit 111 (not shown).

After a casing 100 has been constructed, the piston valve unit 110 attached to the actuating rod to form the piston assembly, which then is inserted into the device. The function of the actuating rod 107 is to transmit pumping force from the actuator 112 to the piston valve unit 110. Consequently, the actuating rod 107 desirably is constructed of a strong, rigid material that will efficiently transmit the reciprocal pumping force of the actuator 112 along the entire length of the actuating rod 107, to move the piston valve unit 110 reciprocally through substantially the entire range of vertical movement of the actuator 112. Particularly in a deep well, where the actuating rod 107 will be relatively long, it is desirable to construct the actuating rod 107 of a material and in a manner so as to maximize the length:mass ratio of the rod 107. In this way, the amount of the pumping force that is expended actuating the actuator rod 107 is minimized and the amount of pumping power utilized for moving liquid through the device in the well is maximized. It is further desirable that the actuating rod 107 have some flexibility, such that it will not break and may be removed from a well if the vertical integrity of the well has been lost due to subsurface shifting in the geological site.

The actuating rod 107 is axially disposed within the casing 100, and thus occupies a volume of the casing 100 through which liquid is elevated during operation of the device. Since, the actuating rod directly contacts the liquid, preferably it is constructed from a material chosen to minimize chemical reactivity with the liquid. For most liquids, stainless steel and fiberglass are preferred materials for constructing the actuating rod 107. Other materials for constructing the actuating rod 107 will be apparent to those skilled in the art, depending on the application for which the pump is designed. To elevate some liquids, it may be desirable to coat a stainless steel actuating rod 107 with an inert organic polymer.

In one embodiment, the actuating rod 107; is constructed from one or more sections of standard, commercially-available stainless steel piping joined together by standard commercially-available stainless steel pipe couplings 120 (FIG. 1B). Such piping combines the desired features of strength, rigidity, some flexibility, and non-reactivity. Sections of piping of standard commercial lengths are coupled together to create an actuating rod 107 of a desired length. As an example, commercially available one-eighth inch thick stainless steel piping and compatible pipe couplings are employed. A major advantage of such piping is its widespread availability—i.e. from an ordinary hardware store—thus facilitating on-sight assembly of a pump on short notice. An actuating rod 107 of almost any chosen length is easily constructed with such piping due to the ability to couple long or short lengths of such piping.

In another embodiment, the actuating rod 107 may be constructed from one or more sections of solid, stainless steel rod. Stainless steel rod will form a stronger actuating rod 107 than comparable pieces of stainless steel piping, but solid rod is heavier, more expensive and less readily available commercially. When the precise length of the actuating rod 107 is known in advance, a single section of steel rod may be cut to order.

An advantage exists in using commercially-available solid stainless steel rod instead of commercially-available stainless steel piping when one considers the commercially-available couplings for these two materials. Sections of commercially-available stainless steel piping commonly have tapered threading at each end. When such piping is employed for its ordinary purpose of transporting liquids, the tapered threading is advantageous for forming leak-proof joints. However, such threading is undesirable when sections of the piping are joined to form an actuating rod 107, because excessive axial torque imparted to the actuating rod 107 may result in a loosening of the connections between the sections of the rod 107. Commercially-available steel rod, in contrast, may be obtained in sections having untapered, threaded ends. Joints formed when sections of straight-threaded rod are coupled are less apt to loosen from torque—particularly if a lock nut is employed as part of the coupling.

In another preferred embodiment, the actuating rod 107 is constructed from fiberglass. A single, continuous length of fiberglass rod may be employed (Fiberflex Inc., Big Spring, Tex. 79721) that can easily be fitted to piston valve unit 110 and actuator 112.

To install the piston assembly, the piston valve unit 110 preferably is attached to the lower end 109 of the actuating rod 107, preferably with threads on the actuating rod and compatible threads 210 of the piston valve unit 110, as shown in FIG. 2A. The piston assembly then is slidably inserted into the upper end 101 of the casing 100. If the actuating rod 107 is constructed of multiple sections of steel rod or steel piping, then additional lengths of the actuating rod 107 may be attached to the piston assembly as it is being lowered into the casing 100. The piston valve unit 110 is lowered until the piston valve unit 110 is disposed within the portion of the liner 103 in which it is to be actuated. The assembled actuating rod 107 preferably is sufficiently long to extend above the surface of the geological site, to facilitate attachment of an actuator 112 to the actuating rod 107 as previously described. The exact length needed for the actuating rod 107 is easily predetermined from the length of casing 100, and is easily adjusted by the attachment or removal of a short length of rod.

Advantages of the device of the present invention are that the piston assembly is "removable," and the ease with which it can be partially or completely retrieved from a well for repair or replacement, or for salvage from an abandoned well. For retrieval, first, any actuator 112 that is operatively connected to the actuating rod 107 and/or to a support is disconnected. The piston assembly then is removed. By "removable" is meant that the piston assembly may be withdrawn from the device without dismantling the casing 100 or liner 103 and without removing these components of the device from the well in which the device has been inserted or assembled. Preferably, the piston assembly can be removed simply by lifting the piston assembly up through the casing 100 in the opposite direction from which it was inserted. Thus, if for example the device has been rendered inoperative because the piston valve unit 110 has clogged with debris or because its outer sealing rings 208*a* and/or 208*b* have worn out, repair or replacement of the device rapidly can be performed on-site by removal of the piston assembly and repair or replacement of the piston valve unit 110. The piston assembly then can be reinserted rapidly into the device to render the device operative. As explained below, the stationary valve unit 111 can be removed for repair or replacement and reinsertion as well. Furthermore, in addition to removal of the piston assembly and the stationary valve unit 111, the casing 100 similarly can be retrieved from a well by lifting and by removing one or more sections, e.g., 100A or 100B of the casing 100 as they are elevated above the surface of the geological site. This may be desirable for salvaging recyclable casing materials from a well that has been rendered inoperative, or for repairs such as cleaning a clogged screen 404 or 113. To clean a clogged screen 404 or 113, the casing 100 also can be back flushed after the valve units 110 and 111 have been removed from the casing 100.

A removable piston assembly is particularly advantageous in the application of the device for removal of leachate from a landfill. As explained above, a landfill is subject to shifting due to the settling and decay of garbage within it. Such shifting may result in the loss of the vertical integrity of a well, rendering the well useless for removal of leachate. However, the rigid actuating rod 107 often can be withdrawn and salvaged from a well, even after the vertical integrity of the well has been lost, due to the measure of flexibility of a long, thin stainless steel rod or pipe, and due to the relatively small diameter of the actuating rod 107.

As previously explained, a novel advantage of the device of the present invention is that the piston assembly is removable. In one embodiment of the device where a liner 103 is not used, the sealing rings 208*a* and 208*b* of the piston valve unit 110 sealingly engage the casing 100. Therefore, during the entire raising of the piston assembly for removal of the piston valve unit 110, any liquid that is disposed above the piston valve unit 110 (i.e., due to prior operation of the device) must be lifted along with the piston valve unit 110 to the surface of the geological site, where the liquid must then be disposed of. Due to the weight of such liquid and the inconvenience of having to dispose of it, it is advantageous that the device have the capability of removing the piston assembly without removal of liquid disposed above the piston value unit 110 in the casing 100.

The liner 103 of the present invention optionally provides an additional advantage in that it may serve as a means for facilitating removal of the piston assembly without removal of the entire column of liquid disposed above the piston valve unit 110. As explained above, the valve units 110 and 111 of the device are disposed within the liner 103 during operation of the device, such that the sealing rings 208*a* and 208*b* sealingly engage the liner 103 to prevent liquid communication around an outer periphery of the valve units 110 and 111 during operation of the device. However, the hollow interior of the liner 103 has a smaller internal diameter than the hollow interior of the casing 100 within which the liner is disposed. Therefore, the sealing rings 208*a* and 208*b* do not sealingly engage the casing 100. Hence, when the piston valve unit 110 is lifted above the upper end 400 of the liner 103, the sealing rings 208*a* and 208*b*, surrounding the piston valve unit, will not prevent liquid communication around the outer periphery of the piston valve unit 110. In the preferred embodiment, the liner 103 occupies only the lowermost section 100A of the casing 100. Thus, after raising the piston valve unit 110 only a small portion of the distance to the surface of the geological site, beyond the top of the liner 103, liquid above the piston valve unit 110 communicates around the piston valve unit valve casing, rather than being raised to the surface of the well. Moreover, if the stationary valve unit 111 is reversibly connected to and is being removed with the piston valve unit 110, then after the valve units have been raised above the top of the liner 103, all liquid above the valve units 110 and 111 will communicate around the outer periphery of the valve units 110 and 111 back into the well. It will be apparent that an identical liquid communication effect is achieved by pushing the stationary valve unit 111 with the piston assembly down through the lower end 402 of liner 103 and/or the lower end 102 of casing 100, provided that the lower valve unit retainer and the valve units themselves are constructed to facilitate dislodging the stationary valve unit in such a manner. In such an embodiment, a screen 113 may be used to catch and retain the dislodged stationary valve unit for retrieval upon removal of the riser pipe 100 from the geological site. This approach for draining the riser pipe 100 is preferred where the stationary valve unit 111 has been attached at the lower end of the riser pipe or lining means outside of the riser pipe or lining means, such that it cannot be removed from the device through the riser pipe with the piston assembly, as described below.

Figure 2H:
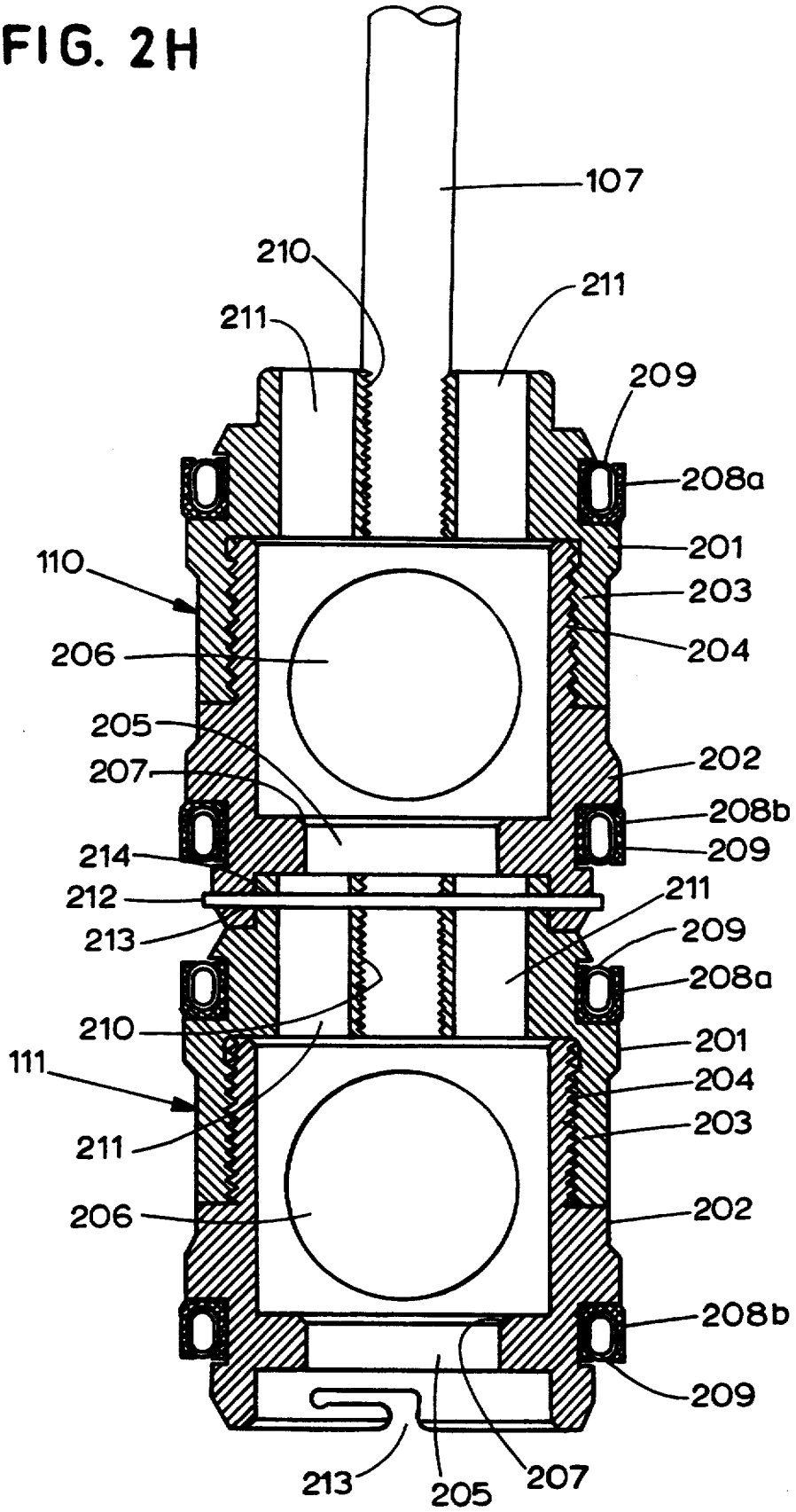
FIG. 2H is a largely cross-sectional view of two interconnected valve units and a cut-away portion of the actuating rod in one embodiment of the device.

In a preferred embodiment, the device of the present invention further includes novel inter-connection structure for reversibly connecting the piston assembly to the stationary valve unit 111, after the stationary valve unit 111 has been positioned within the casing 100 in a well. A preferred interconnection structure is a flange or pin 212 (FIGS. 2A and 2D) on the upper end of stationary valve unit 111 and a compatible slot or recess 213 for receiving the flange or pin 212 on the lower end of piston valve unit 110. When the piston valve unit 110 of the piston assembly and the stationary valve unit 111 are brought in close proximity by lowering the piston assembly, the two valve units can be interconnected by axial rotation of the piston assembly relative to the stationary valve unit, and subsequently disconnected by axial rotation of the piston assembly in an opposite direction relative to the stationary valve unit. For example, referring to FIGS. 1A & 2A, the lowering of the piston assembly until the piston valve unit 110 contacts the stationary valve unit 111, and the subsequent rotation of the piston assembly with concurrent exertion of downward pressure against the stationary valve unit 111, will result in the flange or pin 212 of the stationary valve unit 111 reversibly engaging the recess 213 in piston valve unit 111, thereby reversibly connecting the two valve units 110 and 111 (FIG. 2H). The stationary valve unit 111 is removable from the casing 100 by reversible connection of the piston assembly and the stationary valve unit as described, and by the previously-described capability of removing the piston assembly. Once removed, the stationary valve unit 111 may be repaired or replaced. It will be appreciated that means for removal of the stationary valve unit 111 that destroy the stationary valve unit (e.g., a destroyer cone apparatus) may be employed if replacement of the stationary valve unit is the goal. To reinsert a stationary valve unit 111 into the same or different casing 100, the stationary valve unit is reversibly connected to the piston assembly as previously described, the piston assembly is inserted into the casing 100, and the piston assembly is disconnected from the stationary valve unit 111 by rotation when the stationary valve unit 111 has been inserted to the desired depth. The position of the piston valve unit 110 within the casing 100 is then adjusted by raising the piston assembly. From the foregoing description it should be apparent that alternative reversible interconnection structure may be employed, and that the relative positions of the flange 212 and recess 213 may be reversed.

As shown in FIGS. 2A, 2C, and 2D, a preferred construction of the stationary valve unit 111 having a flange 212 for interconnection with a piston valve unit 110 is to insert a pin 212 preferably constructed from stainless steel through a bore 214 that passes radially through the upper valve casing portion 201. Pin 212 is sufficiently long to completely traverse bore 214 and have exposed ends that, together with recess 213 on piston valve unit 110, serve as interconnection structure as described. It will be apparent that piston valve unit 110 may be constructed without pin 212, so that pin 212 does not interfere with the threaded connection between piston valve unit 110 and actuating rod 107.

Figure 3:
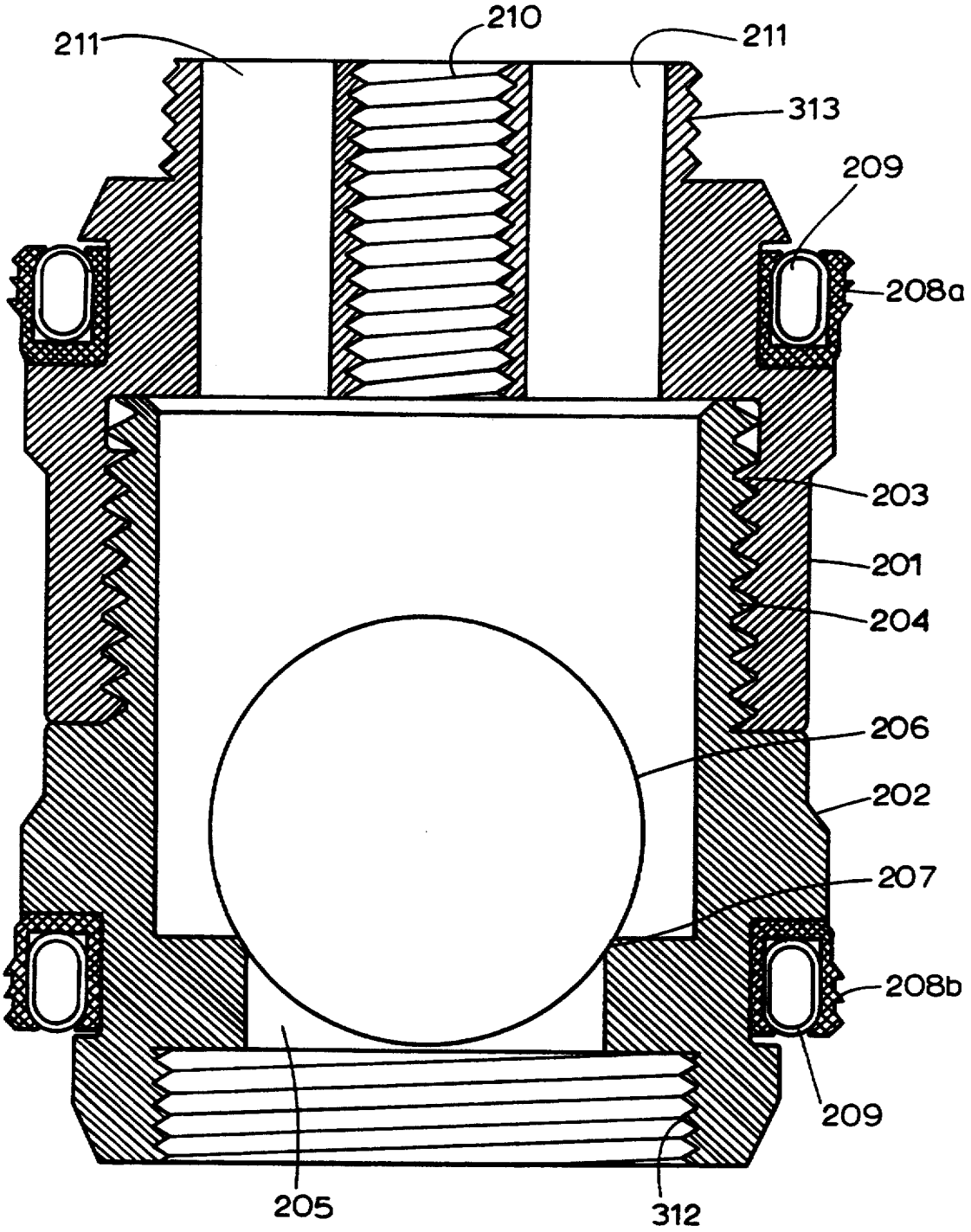
FIG. 3 is an enlarged, largely cross-sectional view of an alternative embodiment of a valve unit.

In another variation shown in FIG. 3, axially aligned, compatible threads 312 and 313 on the lower end of piston valve unit 110 and upper end of stationary valve unit 111 serve as interconnection structure. The piston valve unit 110 can be reversibly connected to the stationary valve unit 111 as described above: by contacting the piston valve unit 110 and the stationary valve unit 111 and rotating the piston assembly axially, such that a female-threaded lower portion 312 of the piston valve unit 110 engages compatible male threads 313 of an identical stationary valve unit 111. Axial rotation of the piston assembly in the opposite direction results in disconnection of the piston valve unit 110 from the stationary valve unit 111. It should be apparent that the valve unit interconnection structure, e.g. threads, of the piston assembly need not be integral with the piston valve unit 110. For example, the interconnections structure may be integral with the actuating rod 107 in an embodiment wherein the actuating rod 107 extends through the piston valve unit 110 and can be made to contact the stationary valve unit 111.

In an embodiment wherein axial rotation is employed to reversibly connect the piston assembly to the stationary valve unit 111, it should be apparent that the torque required for axial rotation of the piston assembly is applied at the surface of the geological site and transmitted through the actuating rod 107 for connecting the stationary valve unit. In such an embodiment, any interconnections between components of the piston assembly (e.g., connections between sections of actuating rod 107 or connections between the actuating rod 107 and piston valve unit 110) must be resistant to loosening or disconnection when such torque is imparted.

In an alternative embodiment to the embodiment described above, the well casing that is first installed in a geological site may also serve as the casing 100 of the device. Valve units are constructed with sealing rings **208*a* and 208*b* that sealingly engage the casing 100 (or liner 103 therein) to prevent liquid communication around an outer periphery of the valve units 110 and 111 during operation of the device. The piston assembly is assembled and inserted into the casing 100 as previously described for an embodiment having a separate casing 100 disposed within a previously-constructed well casing. The stationary valve unit 111 may be inserted into the casing 100 by reversibly connecting the stationary valve unit 111 to the piston assembly prior to insertion of the piston assembly into the casing 100 of the device. The stationary valve unit 111 is positioned in the casing 100 at any desired depth via insertion of the piston assembly to that depth, and then the stationary valve unit 111 is disconnected from the piston assembly as described previously. If a screen 404 or 113 has not been integrated into the well casing or liner therein, then a screen preferably is attached to the stationary valve unit 111 below the valve unit aperture. For certain applications, this embodiment of the device may be the least expensive, and the quickest and easiest to assemble. However, previously described advantages of constructing a device having a separate casing 100 and a liner 103 may not be achieved in such device. For example, in periods during which the piston valve unit 110 and stationary valve unit 111 are disposed within the well casing, the well cannot be used for applications such as the insertion of monitoring probes into the well. If the well casing is constructed with a liner 103, then advantages of a liner 103** can be achieved with this embodiment.

The creation of a well lined by a well casing typically involves an initial step of boring a hole in a geological site. However, one skilled in the art is aware of means and methods for driving a suitable well casing into a geological site without having to bore a well hole as an initial step. For example, Zebra Environmental Corporation (Cedarhurst, N.Y.) manufactures Geoprobe model hydraulic probe/samplers that allow a user to drive a sealed stainless steel pipe having a liquid permeable screen section to a desired depth in a geological site, and open the screen so that a water sample may be obtained through the pipe. Such a pipe is a suitable casing 100 for the device of the present invention, provided that when assembly is complete, the lowermost valve unit, e.g., stationary valve unit 111, is disposed above the liquid-permeable screen portion of the stainless steel pipe. During installation of such a casing into the geological site, the liquid-permeable screen section remains totally enclosed in a protective sheath while driving the casing to the desired depth, and then the screen is exposed to the geological site. Liquid passes into the casing 100 means of the device through this screen section. To facilitate installation of such a casing into the geological site, an expendable drive point, or piercing device, is employed at the lower end 102 of the casing to pierce downwardly into the geological site. One skilled in the art is familiar with other means for installing a well casing into a geological site as well, and such means are intended to fall within the scope of the present invention. For example, techniques for installing a pipe into a geological site using a well point and water-permeable sleeve through which water from the surface may be forced, in order to displace the surrounding earth, are known, and may be effectively employed. A riser pipe is constructed above the sleeve as the well point is driven further into the geological site.

The foregoing detailed description has been given for clearness of understanding only, and no unnecessary limitations should be understood therefrom, as modifications will be obvious to those skilled in the art.

We claim:

1. A device for elevating liquid through a well in a landfill or other geological site, comprising:

a casing means for channeling liquid, said casing means having an upper end and a lower end;

a lining means for lining said casing means, said lining means disposed within said casing means, said lining means having an upper end that is flared radially outward;

a discharge means for removal of liquid from the casing means;

a removable piston means for elevating liquid toward said discharge means, said removable piston means comprising:

an actuating rod having an upper end and a lower end, and a piston valve unit disposed within the casing means and operatively connected to said actuating rod;

a stationary valve unit disposed within said casing means; said stationary valve unit remaining in a substantially fixed position relative to the casing means during movement of the piston means;

each of said valve units comprising:

a valve casing, an aperture within said valve casing, a sealing means for preventing liquid communication around an outer periphery of said valve casing during operation of said device, a valve means for permitting liquid to flow through said valve unit aperture toward the discharge means, and for preventing liquid from flowing through said valve unit aperture away from said discharge means.

2. The device of claim 1 further comprising an actuating means operatively connected to the upper end of said actuating rod for imparting movement to said piston means.

3. The device of claim 1 wherein said stationary valve unit is removable.

4. The device of claim 1 wherein said valve units are disposed within said lining means.

5. The device of claim 1 wherein the sealing means of said valve units prevent liquid communication around an outer periphery of the valve units when said valve units are disposed within said lining means, but permit such liquid communication when said valve units are disposed within said casing means and above said lining means.

6. The device of claim 1 wherein a lower end of said lining means further comprises retaining means for preventing downward movement of a valve unit past said lower end.

7. The device of claim 1 wherein the vertical position of the piston valve unit is adjustable over different portions of said lining means to provide vertical movement of said piston valve unit within the lining means over different portions of said lining means for extending the useful life of said lining means.

8. The device of claim 1 further comprising a filter means disposed below said valve units for preventing debris from contacting said valve units.

9. The device of claim 1 wherein said casing means is disposed within a well casing in the geological site.

10. The device of claim 1 wherein said piston valve unit is substantially identical to said stationary valve unit.

11. The device of claim 1 further comprising retaining means for preventing downward movement of said stationary valve unit.

12. The device of claim 11 wherein the retaining means permits upward movement of the valve unit.

13. The device of claim 1 further comprising engagement means for reversibly connecting the piston means to the stationary valve unit.

14. The device of claim 13 wherein said stationary valve unit is disposed below said piston means, and said engagement means comprises compatible attachment structure disposed on a lower portion of the piston means and on an upper portion of the stationary valve unit.

15. The device of claim 1 wherein the actuating rod comprises a single, continuous length of fiberglass-reinforced rod.

16. A device for elevating liquid through a well in a landfill or other geological site, comprising:

a casing means for channeling liquid, said casing means having an upper end and a lower end;

a lining means for lining said casing means, said lining means disposed within said casing means;

a discharge means for removal of liquid from the casing means;

a piston means for elevating liquid toward said discharge means, said piston means comprising:

an actuating rod having an upper end and a lower end, and a piston valve unit disposed within the lining means and operatively connected to said actuating rod;

a stationary valve unit disposed within said lining means; said stationary valve unit remaining in a substantially fixed position relative to the lining means during movement of the piston means;

each of said valve units comprising a valve means for permitting liquid to flow through said valve unit toward the discharge means, and for preventing liquid from flowing through said valve unit away from said discharge means;

wherein said piston valve unit prevents liquid communication around an outer periphery of said piston valve unit when said piston valve unit is disposed within said lining means, but permits such liquid communication when said piston valve unit is disposed within said casing means and above said lining means.

17. The device of claim 16 wherein said lining means has an upper end that is flared radially outward.

18. A method for removing a valve unit from the device of claim 16 comprising:

removing the piston valve unit from the device by lifting the actuating rod from the casing means sufficiently for removal of the connected piston valve unit.

19. The method of claim 18 for removing the piston valve unit and the stationary valve unit from the device of claim 16, further comprising:

reversibly connecting the stationary valve unit to the piston means before removing the piston valve unit from the device, and lifting the actuating rod sufficiently out of the casing means to expose and remove the stationary valve unit.

20. The device of claim 16 wherein said piston means is removable.

21. The device of claim 16 wherein said stationary valve unit prevents liquid communication around an outer periphery of said stationary valve unit when said stationary valve unit is disposed within said lining means, but permits such liquid communication when said stationary valve unit is disposed within said casing means and above said lining means.

22. The device of claim 16 wherein the actuating rod comprises a single, continuous length of fiberglass-reinforced rod.

23. A method for elevating liquid through a well in a geological site, comprising:

inserting into the geological site a casing means for channeling liquid, said casing means having an upper end and a lower end;

inserting a stationary valve unit into the casing means;

inserting into the casing means a removable piston means for elevating liquid, said piston means comprising:

an actuating rod having an upper end and a lower end, and a piston valve unit operatively connected to said actuating rod;

reciprocally raising and lowering the piston means to elevate liquid from below the surface of the geological site through the casing means toward the surface;

wherein the geological site is a landfill, and the liquid is landfill leachate.

24. The method of claim 23 further comprising:

operatively connecting the upper end of said piston means to an actuating means for raising and lowering said piston means, said actuating means being disposed at the surface of the geological site.

25. The method of claim 23 further comprising:

inserting a lining means for lining said casing means into the casing means;

disposing the stationary valve unit within the lining means;

disposing the piston valve unit of the piston means within the lining means.

26. The method of claim 23 further including the steps of inserting the stationary valve unit and the piston means simultaneously.

27. The method of claim 26 comprising:

reversibly connecting the stationary valve unit and the piston means;

inserting the piston means into the casing means; and disconnecting the stationary valve unit from the piston means.

28. The method of claim 23 further comprising inserting into the geological site a well casing having an upper end and a lower end; and inserting the casing means for channeling liquid into the well casing.

29. The method of claim 28 further comprising removing gas from the well through the upper end of said well casing.

30. The method of claim 23 wherein the actuating rod is a unitary actuating rod.

31. The method of claim 30 wherein the unitary actuating rod comprises a single, continuous length of fiberglass-reinforced rod.

32. A device for elevating liquid through a well in a landfill or other geological site, comprising:

a casing means for channeling liquid, said casing means having an upper end and a lower end;

a discharge means for removal of liquid from the casing means;

a removable piston means for elevating liquid toward said discharge means, said piston means comprising:

an actuating rod having an upper end and a lower end, and a piston valve unit disposed within the casing means and operatively connected to said actuating rod;

a removable stationary valve unit disposed within said casing means; said stationary valve unit remaining in a substantially fixed position relative to the casing means during movement of the piston means;

engagement means for reversibly connecting the piston means to the stationary valve unit, said engagement means comprising a structure selected from a flange and a pin attached to one of said piston means and said stationary valve unit, wherein the other of said piston means and said stationary valve unit has a compatible slot or recess for receiving the flange or pin.

33. The device of claim 32 further comprising a lining means for lining said casing means, said lining means disposed within said casing means.

34. The device of claim 32 wherein the stationary valve unit is removable from the casing means by connection of the piston means to the stationary valve unit for removal of the piston means and the stationary valve unit.

35. The device of claim 34 wherein, after the stationary valve unit has been removed, a stationary valve unit is reinsertable by connection of the stationary valve unit to the piston means, reinsertion of the piston means into the casing means, and subsequent disconnection of the piston means and the stationary valve unit.

36. The device of claim 32 wherein said stationary valve unit is disposed below said piston means.

37. The device of claim 36 wherein upon lowering of the piston means such that said piston means contacts said stationary valve unit and upon axial rotation of said piston means, the piston means and stationary valve units reversibly engage.

38. A device for elevating liquid through a well in a landfill or other geological site, comprising:

a casing means for channeling liquid, said casing means having an upper end and a lower end;

a discharge means for removal of liquid from the casing means;

a piston means for elevating liquid toward said discharge means, said piston means comprising:

a unitary actuating rod having an upper end and a lower end, and a piston valve unit disposed within the casing means and operatively connected to said actuating rod;

a stationary valve unit disposed within said casing means; said stationary valve unit remaining in a substantially fixed position relative to the casing means during movement of the piston means.

39. The device of claim 38 wherein the unitary actuating rod comprises a single, continuous length of fiberglass-reinforced rod.

* * * * *

UNITED STATES PATENT AND TRADEMARK OFFICE

CERTIFICATE OF CORRECTION

PATENT NO. : 5,429,193

DATED : July 4, 1995

INVENTOR(S) : Hegebarth et al.

It is certified that error appears in the above-identified patent and that said Letters Patent is hereby corrected as shown below:

Col. 4, line 55, after the word "may" insert --,--.

Col. 8, line 55, change "Same" to --same--.

Col. 17, line 15, after the word "rod" insert --107--.

Col. 17, line 52, after "107" delete --;--.

Signed and Sealed this

Twenty-sixth Day of March, 1996

Bruce Lehman

*Attest:*

BRUCE LEHMAN

*Attesting Officer*

*Commissioner of Patents and Trademarks*